US007717536B2

(12) United States Patent
Endo

(10) Patent No.: US 7,717,536 B2
(45) Date of Patent: May 18, 2010

(54) LIQUID EJECTING APPARATUS, COMPUTER SYSTEM, AND LIQUID EJECTION METHOD

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/421,989

(22) Filed: Apr. 10, 2009

(65) Prior Publication Data

US 2009/0219321 A1 Sep. 3, 2009

Related U.S. Application Data

(62) Division of application No. 10/526,773, filed on Sep. 23, 2005, now Pat. No. 7,537,302.

(51) Int. Cl.
*B41J 29/393* (2006.01)

(52) U.S. Cl. ..... 347/19; 347/105

(58) Field of Classification Search ..... 347/16, 347/19, 104, 105

See application file for complete search history.

(56) References Cited

U.S. PATENT DOCUMENTS 6,161,914 A * 12/2000 Haselby ..... 347/19
6,189,993 B1 2/2001 Mantell
6,241,334 B1 * 6/2001 Haselby ..... 347/19
6,607,260 B1 * 8/2003 Ikeda ..... 347/19
2002/0044168 A1 4/2002 Hashi et al.

FOREIGN PATENT DOCUMENTS

| | | | |
|---|---|---|---|
| EP | 1 096 780 | A | 5/2001 |
| EP | 1 190 864 | A | 3/2002 |
| EP | 1 531 055 | A | 5/2005 |
| JP | 2-255360 | A | 10/1990 |
| JP | 4-21482 | A | 1/1992 |
| JP | 2000-1033 | A | 1/2000 |
| JP | 2002-103586 | A | 4/2002 |

* cited by examiner

*Primary Examiner*—Lamson D Nguyen
(74) *Attorney, Agent, or Firm*—Sughrue Mion, PLLC

(57) ABSTRACT

A liquid ejecting apparatus etc. creating no blank space on a medium is achieved. The liquid ejecting apparatus has: a movable ejection head for ejecting a liquid; a feed mechanism for feeding a medium; and detecting means for detecting a position of an edge of the medium; wherein the apparatus repeats an operation of detecting the position of the edge with the detecting means, an operation of feeding the medium with the feed mechanism, and an operation of ejecting the liquid onto the medium from the moving ejection head; in accordance with the position of the edge that has been detected, the apparatus changes at least either one of a start position and an end position for ejecting the liquid from the moving ejection head; and if the position of the edge was not detected, the apparatus sets the start position or the end position to a position that has been established in advance.

8 Claims, 13 Drawing Sheets

LIQUID EJECTING APPARATUS, COMPUTER SYSTEM, AND LIQUID EJECTION METHOD

CROSS-REFERENCE TO RELATED APPLICATIONS

This is a Divisional of application Ser. No. 10/526,773 filed on Sep. 23, 2005, which is a National Stage Entry of PCT Application No. PCT/JP03/10959, filed on Aug. 28, 2003, which claims priority from Japanese Patent Application 2002-262974 filed on Sep. 9, 2002. The entire disclosures of the prior applications are considered part of the disclosure of the accompanying divisional application and are hereby incorporated by reference in their entirety.

TECHNICAL FIELD

The present invention relates to liquid ejecting apparatuses, computer systems, and liquid ejection methods.

BACKGROUND ART

Color inkjet printers, which are typical liquid ejecting apparatuses, are already well known. A color inkjet printer is provided with a print head which serves as an example of an inkjet-type ejection head that ejects, from nozzles, ink which is an example of a liquid, and it is configured to record images, characters, and so forth by ejecting ink onto print paper, which serves as an example of a medium.

The print head is supported on a carriage in such a state that the nozzle surface in which the nozzles are formed is in opposition to the print paper, and moves (performs main scan) along a guide member in the direction of the width of the print paper and ejects ink in synchronization with the main scan.

In recent years, color inkjet printers that are capable of performing so-called borderless printing, in which printing is performed with respect to the entire surface of the print paper, are gaining popularity for such reasons as that it is possible to obtain output results that look like photographs. Through borderless printing, it is possible, for example, to perform printing by ejecting ink without forming any blank space even in the edges on the four sides of the print paper.

In borderless printing, in order to perform printing with respect to the entire surface of the print paper, it is important not to form any blank space in the edges of the print paper that is printed on. To achieve this, it is advantageous to adopt a method of preparing print data which is slightly larger than the print paper, that is, which includes a certain amount of margin with respect to the size of the print paper, and performing printing on the print paper in accordance with this print data, taking into consideration situations in which the print paper is supplied in a slanted (skewed) manner.

Further, in order to eliminate the problem of the above-described method, that is, the problem that ink is uselessly consumed by performing printing on a region outside the print paper, it is advantageous to adopt a method of detecting the position of the edge of the print paper with detecting means and changing the start position and/or the end position for ejecting ink in accordance with the detected edge position.

However, in carrying out this method, situations may occur in which the position of the edge of the print paper is not detected due to some reason. In such a situation, if the start position and/or the end position for ejecting ink is determined simply by using information about the position of an edge that was previously detected, instead of information about the position of the relevant edge, without changing the way of determining the start position and/or the end position for ejecting ink, then a problem that a blank space is unintentionally created on the print paper may arise. More specifically, the position of the edge that should have been detected and the position of an edge that was previously detected may significantly differ due to the print paper being supplied in a slanted (skewed) manner, and therefore, the above-described problem may arise if the start position and/or the end position is determined simply by using information about the position of an edge that was previously detected without changing the way of determining the start position and/or the end position for ejecting ink.

The present invention has been made in view of these issues, and an object thereof is to achieve a liquid ejecting apparatus and a computer system with which no blank space is created on a medium.

DISCLOSURE OF INVENTION

A main invention is a liquid ejecting apparatus comprising: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid onto the medium from the ejection head that is moving; wherein, in accordance with the position of the edge that has been detected, the liquid ejecting apparatus changes at least either one of a start position and an end position for ejecting the liquid from the ejection head that is moving; and wherein, if the position of the edge was not detected, the liquid ejecting apparatus sets the start position or the end position to a position that has been established in advance.

Other features of the present invention are made clear through the present specification and the description of the accompanying drawings.

Figure 1:
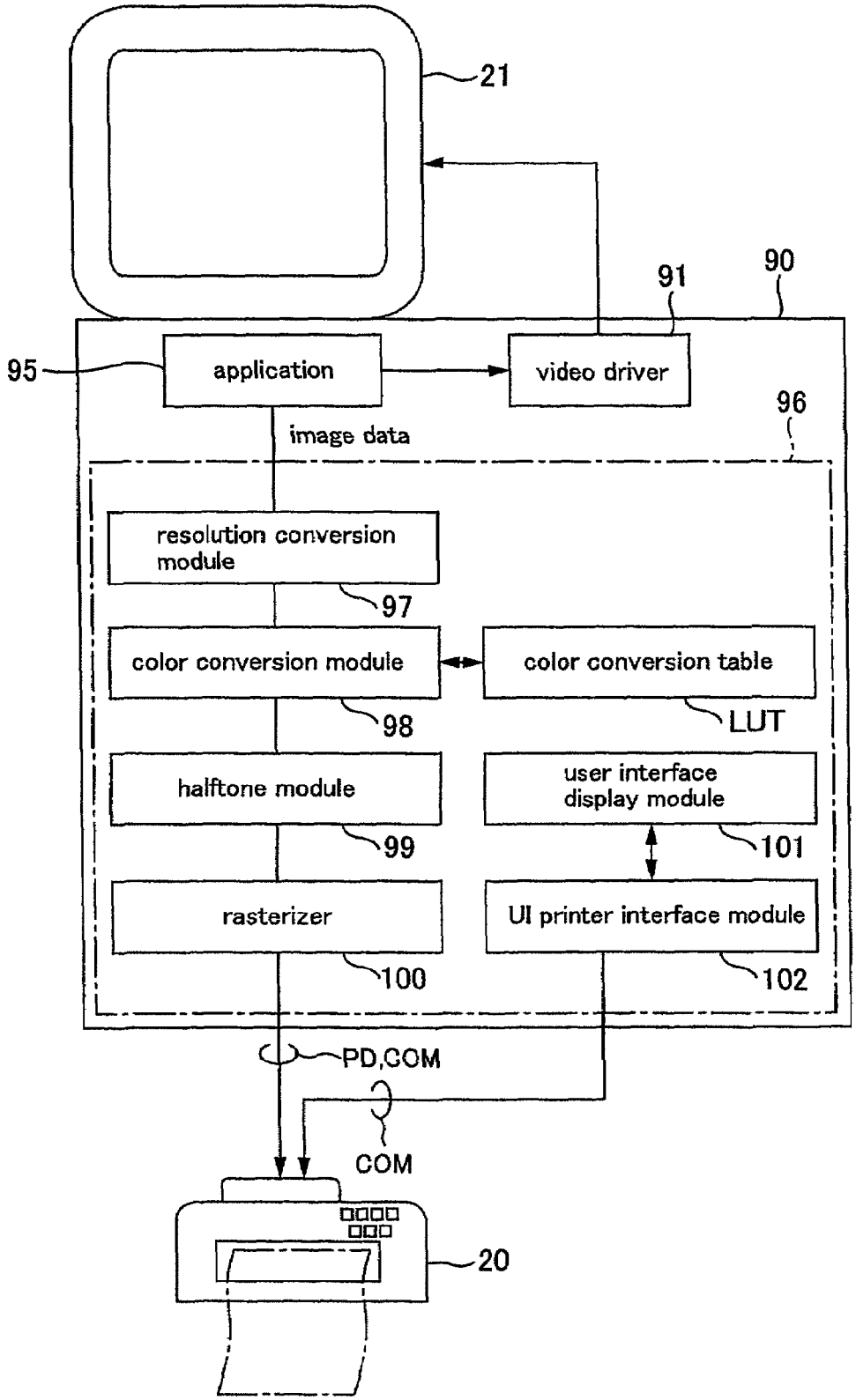
FIG. 1 is a block diagram showing the configuration of a printing system serving as an example of the present invention.

Legends of the main reference characters used in the drawings are shown below:

11 linear encoder
12 linear encoder code plate
13 rotary encoder
14 rotary encoder code plate
20 color inkjet printer
21 CRT
22 paper stacker
24 paper feed roller
25 pulley
26 platen
28 carriage
29 reflective optical sensor
30 carriage motor
31 paper feed motor
32 pull belt
34 guide rails
36 print head
38 light-emitting section
40 light-receiving section
50 buffer memory
52 image buffer
54 system controller
56 main memory
58 EEPROM
61 main-scan drive circuit
62 sub-scan drive circuit
63 head drive circuit
65 reflective optical sensor control circuit
66 electric signal measuring section
90 computer
91 video driver
95 application program
96 printer driver
97 resolution conversion module
98 color conversion module
99 halftone module
100 rasterizer
101 user interface display module
102 UI printer interface module
1000 computer system
1102 main computer unit
1104 display device
1106 printer
1108 input device
1108A keyboard
1108B mouse
1110 reading device
1110A flexible disk drive device
1110B CD-ROM drive device
1202 internal memory
1204 hard disk drive unit

BEST MODE FOR CARRYING OUT THE INVENTION

At least the following will be made clear through the present specification and the description of the accompanying drawings.

A liquid ejecting apparatus comprises: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid onto the medium from the ejection head that is moving; wherein, in accordance with the position of the edge that has been detected, the liquid ejecting apparatus changes at least either one of a start position and an end position for ejecting the liquid from the ejection head that is moving; and wherein, if the position of the edge was not detected, the liquid ejecting apparatus sets the start position or the end position to a position that has been established in advance.

It becomes possible to prevent a blank space from unintentionally being created on the medium by setting the start position or the end position to a position that has been established in advance in a case where the position of the edge was not detected.

Further, a liquid ejecting apparatus comprises: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid onto the medium from the ejection head that is moving; wherein, in accordance with the position of the edge that has been detected, the liquid ejecting apparatus changes at least either one of a start position and an end position for ejecting the liquid from the ejection head that is moving; and wherein, if the position of the edge was not detected, the liquid ejecting apparatus determines the start position or the end position based on a position of the edge that was detected in the past.

It becomes possible to prevent a blank space from unintentionally being created on the medium by determining the start position or the end position based on a position of the edge that was detected in the past in a case where the position of the edge was not detected.

Further, if the position of the edge was not detected, the start position or the end position may be determined based on a plurality of positions of the edge that were detected in the past.

In this way, it is possible to determine an appropriate start position or end position more accurately.

Further, if the position of the edge was not detected, the position of the edge that was not detected may be obtained from the plurality of positions of the edge that were detected in the past, and the start position or the end position may be determined based on the position of the edge that has been obtained.

In this way, it is possible to determine the start position or the end position more easily.

Further, if the position of the edge was not detected, the position of the edge that was not detected may be obtained from two positions of the edge that were detected in the past, and the start position or the end position may be determined based on the position of the edge that has been obtained.

In this way, it is possible to determine the start position or the end position from minimum information regarding the positions of the edge that were detected in the past.

Further, if the position of the edge was not detected, the position of the edge that was not detected may be obtained from the plurality of positions of the edge that were detected in the past and a feed amount by which the medium was fed from when the positions of the edge were detected, and the start position or the end position may be determined based on the position of the edge that has been obtained.

In this way, it is possible to determine an appropriate start position or end position more accurately.

Further, if the position of the edge was not detected, the start position or the end position may be determined based on a single position of the edge that was detected in the past and a predicted maximum skew angle of the medium.

In this way, it is possible to determine the start position or the end position from minimum information regarding the position of the edge that was detected in the past.

Further, if the position of the edge was not detected, the position of the edge that was not detected may be obtained from the single position of the edge that was detected in the past and the predicted maximum skew angle of the medium, and the start position or the end position may be determined based on the position of the edge that has been obtained.

In this way, it is possible to determine the start position or the end position more easily.

Further, if the position of the edge was not detected, the position of the edge that was not detected may be obtained from the single position of the edge that was detected in the past, a feed amount by which the medium was fed from when the position of the edge was detected, and the predicted maximum skew angle of the medium, and the start position or the end position may be determined based on the position of the edge that has been obtained.

In this way, it is possible to determine an appropriate start position or end position more accurately.

Further, a liquid ejecting apparatus comprises: a movable ejection head for ejecting a liquid; a feed mechanism for feeding a medium; and detecting means for detecting positions of both edges of the medium; wherein the liquid ejecting apparatus repeats an operation of detecting the positions of both edges with the detecting means, an operation of feeding the medium with the feed mechanism, and an operation of ejecting the liquid onto the medium from the ejection head that is moving; wherein, in accordance with at least either one of the positions of both edges that have been detected, the liquid ejecting apparatus changes at least either one of a start position and an end position for ejecting the liquid from the ejection head that is moving; and wherein, if a position of one edge, of among the positions of both edges, was not detected, the liquid ejecting apparatus determines the start position or the end position based on a position of the other edge, of among the positions of both edges.

It becomes possible to prevent a blank space from unintentionally being created on the medium by determining the start position or the end position based on the position of the other edge, of among the positions of both edges, in a case where the position of one edge, of among the positions of both edges, was not detected.

Further, if the position of one edge, of among the positions of both edges, was not detected, the position of the one edge that was not detected may be obtained from the position of the other edge, of among the positions of both edges, and the start position or the end position may be determined based on the position of the one edge that has been obtained.

In this way, it is possible to determine the start position or the end position more easily.

Further, if the position of one edge, of among the positions of both edges, was not detected, the position of the one edge that was not detected may be obtained from the position of the other edge, of among the positions of both edges, and a width of the medium, and the start position or the end position may be determined based on the position of the one edge that has been obtained.

In this way, it is possible to determine an appropriate start position or end position more accurately.

Further, the liquid may be ejected with respect to the entire surface of the medium.

The advantages of the above-described means become more significant when the liquid is ejected with respect to the entire surface of the medium, because the liquid is ejected also onto the edges of the medium.

Further, the detecting means may include light-emitting means for emitting light, and a light-receiving sensor for receiving the light that moves in a main-scanning direction in accordance with the movement of the light-emitting means in the main-scanning direction; and the position of the edge may be detected based on a change in an output value of the light-receiving sensor caused by the light emitted from the light-emitting means that moves in the main-scanning direction passing across the edge.

In this way, it is possible to detect the position of the edge more easily.

Further, positions of two edges that differ in position in the main-scanning direction may be detected based on the change in the output value of the light-receiving sensor caused by the light emitted from the light-emitting means that moves in the main-scanning direction passing across the edges; and the start position may be changed in accordance with one of the positions of the two edges that were detected, and the end position may be changed in accordance with the other of the positions of the two edges that were detected.

In this way, the above-described effect, that is, the effect of being able to prevent a blank space from unintentionally being created on the medium, will be achieved more significantly.

Further, the detecting means may be provided on a movable moving member provided with the ejection head.

In this way, it is possible to share the mechanism for moving the moving member and the detecting means.

Further, while the moving member is moved in a main-scanning direction, the position of the edge may be detected based on a change in an output value of the light-receiving sensor caused by the light emitted from the light-emitting means that moves in the main-scanning direction passing across the edge, and the liquid may be ejected from the ejection head onto the medium.

In this way, it is possible to achieve efficient operation of the liquid ejecting apparatus.

Further, the liquid may be ink; and the liquid ejecting apparatus may be a printing apparatus that performs printing on a medium to be printed, which serves as the medium, by ejecting the ink from the ejection head.

In this case, it is possible to achieve a printing apparatus that takes the effects described above.

It is also possible to achieve a liquid ejecting apparatus comprising: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid with respect to an entire surface of the medium from the ejection head that is moving; wherein, in accordance with the position of the edge that has been detected, the liquid ejecting apparatus changes at least either one of a start position and an end position for ejecting the liquid from the ejection head that is moving; wherein, if the position of the edge was not detected, the liquid ejecting apparatus sets the start position or the end position to a position that has been established in advance; wherein the detecting means includes light-emitting means for emitting light, and a light-receiving sensor for receiving the light that moves in a main-scanning direction in accordance with the movement of the light-emitting means in the main-scanning direction; wherein positions of two edges that differ in position in the main-scanning direction are detected based on a change in an output value of the light-receiving sensor caused by the light emitted from the light-emitting means that moves in the main-scanning direction passing across the edges; wherein the start position is changed in accordance with one of the positions of the two edges that were detected, and the end position is changed in accordance with the other of the positions of the two edges that were detected; wherein the detecting means is provided on a movable moving member provided with the ejection head; wherein, while the moving member is moved in the main-scanning direction, the position of the edge is detected based on the change in the output value of the light-receiving sensor caused by the light emitted from the light-emitting means that moves in the main-scanning direction passing across the edge, and the liquid is ejected from the ejection head onto the medium; wherein the liquid is ink; and wherein the liquid ejecting apparatus is a printing apparatus that performs printing on a medium to be printed, which serves as the medium, by ejecting the ink from the ejection head.

It is also possible to achieve a liquid ejecting apparatus comprising: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid with respect to an entire surface of the medium from the ejection head that is moving; wherein, in accordance with the position of the edge that has been detected, the liquid ejecting apparatus changes at least either one of a start position and an end position for ejecting the liquid from the ejection head that is moving; wherein, if the position of the edge was not detected, the liquid ejecting apparatus obtains the position of the edge that was not detected from two positions of the edge that were detected in the past and a feed amount by which the medium was fed from when the positions of the edge were detected, and determines the start position or the end position based on the position of the edge that has been obtained; wherein the detecting means includes light-emitting means for emitting light, and a light-receiving sensor for receiving the light that moves in a main-scanning direction in accordance with the movement of the light-emitting means in the main-scanning direction; wherein positions of two edges that differ in position in the main-scanning direction are detected based on a change in an output value of the light-receiving sensor caused by the light emitted from the light-emitting means that moves in the main-scanning direction passing across the edges; wherein the start position is changed in accordance with one of the positions of the two edges that were detected, and the end position is changed in accordance with the other of the positions of the two edges that were detected; wherein the detecting means is provided on a movable moving member provided with the ejection head; wherein, while the moving member is moved in the main-scanning direction, the position of the edge is detected based on the change in the output value of the light-receiving sensor caused by the light emitted from the light-emitting means that moves in the main-scanning direction passing across the edge, and the liquid is ejected from the ejection head onto the medium; wherein the liquid is ink; and wherein the liquid ejecting apparatus is a printing apparatus that performs printing on a medium to be printed, which serves as the medium, by ejecting the ink from the ejection head.

It is also possible to achieve a liquid ejecting apparatus comprising: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid with respect to an entire surface of the medium from the ejection head that is moving; wherein, in accordance with the position of the edge that has been detected, the liquid ejecting apparatus changes at least either one of a start position and an end position for ejecting the liquid from the ejection head that is moving; wherein, if the position of the edge was not detected, the liquid ejecting apparatus obtains the position of the edge that was not detected from a single position of the edge that was detected in the past, a feed amount by which the medium was fed from when the position of the edge was detected, and a predicted maximum skew angle of the medium, and determines the start position or the end position based on the position of the edge that has been obtained; wherein the detecting means includes light-emitting means for emitting light, and a light-receiving sensor for receiving the light that moves in a main-scanning direction in accordance with the movement of the light-emitting means in the main-scanning direction; wherein positions of two edges that differ in position in the main-scanning direction are detected based on a change in an output value of the light-receiving sensor caused by the light emitted from the light-emitting means that moves in the main-scanning direction passing across the edges; wherein the start position is changed in accordance with one of the positions of the two edges that were detected, and the end position is changed in accordance with the other of the positions of the two edges that were detected; wherein the detecting means is provided on a movable moving member provided with the ejection head; wherein, while the moving member is moved in the main-scanning direction, the position of the edge is detected based on the change in the output value of the light-receiving sensor caused by the light emitted from the light-emitting means that moves in the main-scanning direction passing across the edge, and the liquid is ejected from the ejection head onto the medium; wherein the liquid is ink; and wherein the liquid ejecting apparatus is a printing apparatus that performs printing on a medium to be printed, which serves as the medium, by ejecting the ink from the ejection head.

It is also possible to achieve a liquid ejecting apparatus comprising: a movable ejection head for ejecting a liquid; a feed mechanism for feeding a medium; and detecting means for detecting positions of both edges of the medium; wherein the liquid ejecting apparatus repeats an operation of detecting the positions of both edges with the detecting means, an operation of feeding the medium with the feed mechanism, and an operation of ejecting the liquid with respect to an entire surface of the medium from the ejection head that is moving; wherein, in accordance with at least either one of the positions of both edges that have been detected, the liquid ejecting apparatus changes at least either one of a start position and an end position for ejecting the liquid from the ejection head that is moving; wherein, if a position of one edge, of among the positions of both edges, was not detected, the liquid ejecting apparatus obtains the position of the one edge that was not detected from the position of the other edge, of among the positions of both edges, and a width of the medium, and determines the start position or the end position based on the position of the one edge that has been obtained; wherein the detecting means includes light-emitting means for emitting light, and a light-receiving sensor for receiving the light that moves in a main-scanning direction in accordance with the movement of the light-emitting means in the main-scanning direction; wherein positions of two edges that differ in position in the main-scanning direction are detected based on a change in an output value of the light-receiving sensor caused by the light emitted from the light-emitting means that moves in the main-scanning direction passing across the edges; wherein the start position is changed in accordance with one of the positions of the two edges that were detected, and the end position is changed in accordance with the other of the positions of the two edges that were detected; wherein the detecting means is provided on a movable moving member provided with the ejection head; wherein, while the moving member is moved in the main-scanning direction, the position of the edge is detected based on the change in the output value of the light-receiving sensor caused by the light emitted from the light-emitting means that moves in the main-scanning direction passing across the edge, and the liquid is ejected from the ejection head onto the medium; wherein the liquid is ink; and wherein the liquid ejecting apparatus is a printing apparatus that performs printing on a medium to be printed, which serves as the medium, by ejecting the ink from the ejection head.

It is also possible to achieve a computer system comprising: a main computer unit; a display device that is connectable to the main computer unit; and a liquid ejecting apparatus that is connectable to the main computer unit and that is provided with: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid onto the medium from the ejection head that is moving; wherein, in accordance with the position of the edge that has been detected, the liquid ejecting apparatus changes at least either one of a start position and an end position for ejecting the liquid from the ejection head that is moving; and wherein, if the position of the edge was not detected, the liquid ejecting apparatus sets the start position or the end position to a position that has been established in advance.

It is also possible to achieve a computer system comprising: a main computer unit; a display device that is connectable to the main computer unit; and a liquid ejecting apparatus that is connectable to the main computer unit and that is provided with: a movable ejection head for ejecting a liquid; a feed mechanism for feeding a medium; and detecting means for detecting a position of an edge of the medium; wherein the liquid ejecting apparatus repeats an operation of detecting the position of the edge with the detecting means, an operation of feeding the medium with the feed mechanism, and an operation of ejecting the liquid onto the medium from the ejection head that is moving; wherein, in accordance with the position of the edge that has been detected, the liquid ejecting apparatus changes at least either one of a start position and an end position for ejecting the liquid from the ejection head that is moving; and wherein, if the position of the edge was not detected, the liquid ejecting apparatus determines the start position or the end position based on a position of the edge that was detected in the past.

It is also possible to achieve a computer system comprising: a main computer unit; a display device that is connectable to the main computer unit; and a liquid ejecting apparatus that is connectable to the main computer unit and that is provided with: a movable ejection head for ejecting a liquid; a feed mechanism for feeding a medium; and detecting means for detecting positions of both edges of the medium; wherein the liquid ejecting apparatus repeats an operation of detecting the positions of both edges with the detecting means, an operation of feeding the medium with the feed mechanism, and an operation of ejecting the liquid onto the medium from the ejection head that is moving; wherein, in accordance with at least either one of the positions of both edges that have been detected, the liquid ejecting apparatus changes at least either one of a start position and an end position for ejecting the liquid from the ejection head that is moving; and wherein, if a position of one edge, of among the positions of both edges, was not detected, the liquid ejecting apparatus determines the start position or the end position based on a position of the other edge, of among the positions of both edges.

Computer systems achieved as above become superior to conventional systems as a whole.

It is also possible to achieve a liquid ejection method of ejecting a liquid onto a medium, comprising: a step of detecting a position of an edge of the medium with a sensor; a step of feeding the medium; and a step of changing, in accordance with the position of the edge that has been detected, at least either one of a start position and an end position for ejecting the liquid from an ejection head that is moving; wherein, if the position of the edge was not detected, the start position or the end position is set to a position that has been established in advance.

It is also possible to achieve a liquid ejection method of ejecting a liquid onto a medium, comprising: a step of detecting a position of an edge of the medium with a sensor; a step of feeding the medium; and a step of changing, in accordance with the position of the edge that has been detected, at least either one of a start position and an end position for ejecting the liquid from an ejection head that is moving; wherein, if the position of the edge was not detected, the start position or the end position is determined based on a position of the edge that was detected in the past.

It is also possible to achieve a liquid ejection method of ejecting a liquid onto a medium, comprising: a step of detecting a position of an edge of the medium with a sensor; a step of feeding the medium; and a step of changing, in accordance with the position of the edge that has been detected, at least either one of a start position and an end position for ejecting the liquid from an ejection head that is moving; wherein, if a position of one edge, of among the positions of both edges, was not detected, the start position or the end position is determined based on a position of the other edge, of among the positions of both edges.

===Example of the Overall Configuration of the Apparatus===

FIG. 1 is a block diagram showing the configuration of a printing system serving as an example of the present invention. The printing system is provided with a computer 90 and a color inkjet printer 20, which is an example of a liquid ejecting apparatus. It should be noted that the printing system including the color inkjet printer 20 and the computer 90 can also be broadly referred to as a "liquid ejecting apparatus." Although not shown in the diagram, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD to be transferred to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 grades, for example. The halftone module 99 executes so-called halftone processing to create halftone image data. The halftone image data are arranged by the rasterizer 100 into the order in which they are to be transferred to the color inkjet printer 20, and are output as the final print data PD. The print data PD include raster data indicating the state in which dots are formed during each main scan, and data indicating the sub-scan feed amount.

The user interface display module 101 has a function of displaying various types of user interface windows related to printing and a function of receiving input from the user in these windows.

The UI printer interface module 102 functions as an interface between the user interface (UI) and the color inkjet printer. It interprets instructions given by users through the user interface and sends various commands COM to the color inkjet printer. Conversely, it also interprets commands COM received from the color inkjet printer and executes various displays with respect to the user interface.

It should be noted that the printer driver 96 achieves, for example, a function of sending and receiving various types of commands COM and a function of supplying print data PD to the color inkjet printer 20. A program for realizing the functions of the printer driver 96 is supplied in a format in which it is stored on a computer-readable storage medium. Examples of this storage medium include various types of computer-readable media, such as flexible disks, CD-ROMs, magneto optical disks, IC cards, ROM cartridges, punch cards, printed materials on which a code such as a bar code is printed, internal storage devices (memory such as a RAM or a ROM) and external storage devices of the computer. The computer program can also be downloaded onto the computer 90 via the Internet.

Figure 2:
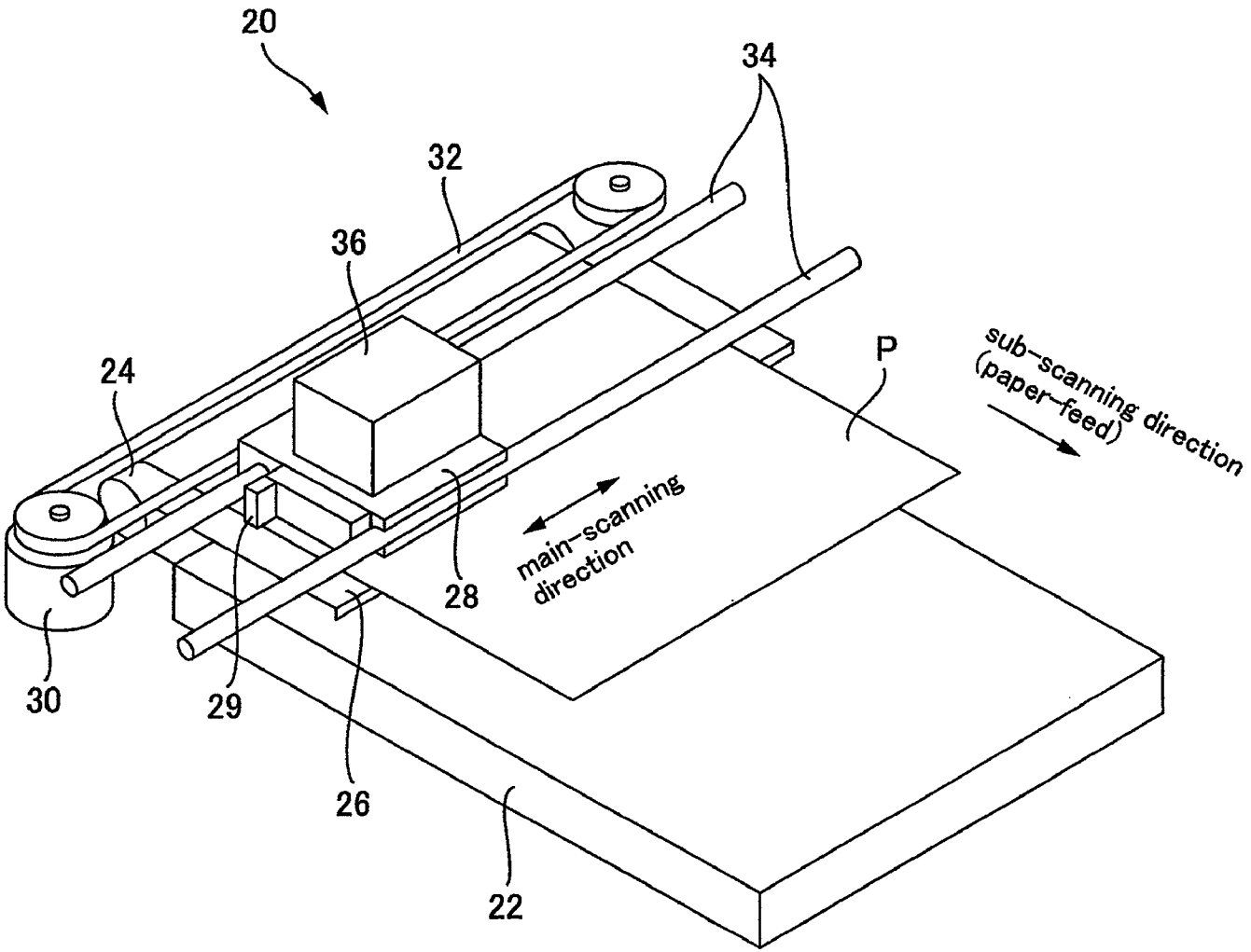
FIG. 2 is a schematic perspective view showing an example of the primary structures of a color inkjet printer 20.

FIG. 2 is a schematic perspective view showing an example of the primary structures of the color inkjet printer 20. The color inkjet printer 20 is provided with a paper stacker 22, a paper feed roller 24 driven by a step motor that is not shown, a platen 26, a carriage 28 serving as an example of a moving member that is movable and that is provided with a print head for forming dots, a carriage motor 30, a pull belt 32 that is driven by the carriage motor 30, and guide rails 34 for the carriage 28. Further, a print head 36, which is an example of an ejection head provided with numerous nozzles, and a reflective optical sensor 29, which serves as an example of detecting means (sensor) described in detail later, are mounted onto the carriage 28.

The print paper P is rolled from the paper stacker 22 by the paper feed roller 24 and fed in a paper-feed direction (hereinafter also referred to as the sub-scanning direction) over the surface of the platen 26. The carriage 28 is pulled by the pull belt 32, which is driven by the carriage motor 30, and moves in the main-scanning direction along the guide rails 34. It should be noted that as shown in the diagram, the main-scanning direction refers to the two directions perpendicular to the sub-scanning direction. The paper feed roller 24 is also used to carry out the paper supply operation for supplying the print paper P to the color inkjet printer 20 and the paper discharge operation for discharging the print paper P from the color inkjet printer 20.

===Example of Configuration of the Reflective Optical Sensor===

Figure 3:
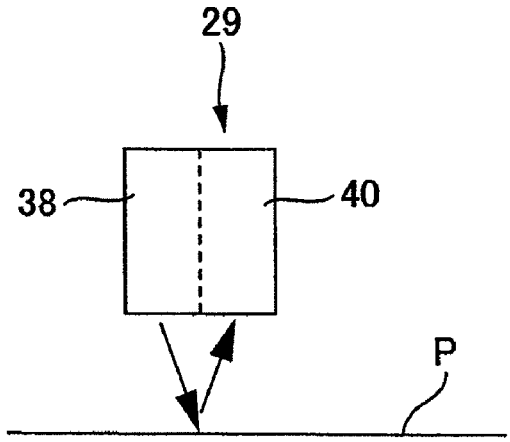
FIG. 3 is a schematic diagram for describing an example of a reflective optical sensor 29.

FIG. 3 is a schematic diagram for describing an example of the reflective optical sensor 29. The reflective optical sensor 29 is attached to the carriage 28, and has a light-emitting section 38, which is for example made of a light emitting diode and is an example of a light-emitting means, and a light-receiving section 40, which is for example made of a phototransistor and is an example of a light-receiving sensor. The light that is emitted from the light-emitting section 38, that is, the incident light, is reflected by print paper P or by the platen 26 if there is no print paper P in the direction in which the emitted light travels. The light that is reflected is received by the light-receiving section 40 and is converted into an electric signal. Then, the magnitude of the electric signal is measured as the output value of the light-receiving sensor corresponding to the intensity of the reflected light that is received.

It should be noted that in the above description, as shown in the figure, the light-emitting section 38 and the light-receiving section 40 are provided as a single unit and together constitute the reflective optical sensor 29. However, they may also constitute separate devices, such as a light emitting device and a light-receiving device.

Further, in the above description, the reflected light was converted into an electric signal and then the magnitude of that electric signal was measured in order to obtain the intensity of the reflected light that is received. However, this is not a limitation, and it is only necessary that the output value of the light-receiving sensor corresponding to the intensity of the reflected light that is received can be measured.

===Example of Configuration of the Periphery of the Carriage===

Figure 4:
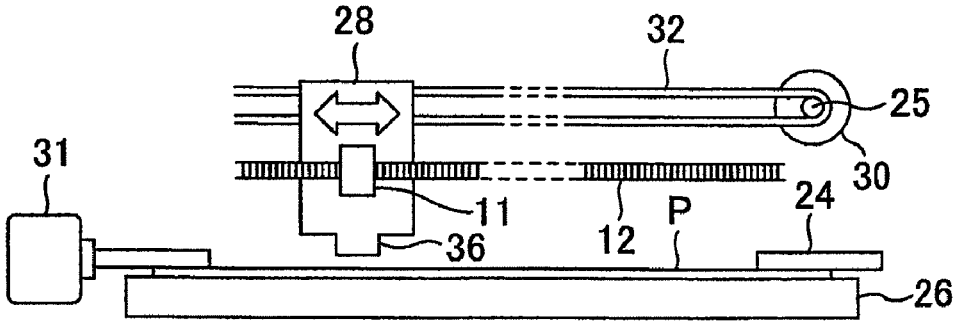
FIG. 4 is a diagram showing the configuration of the periphery of a carriage 28 of the inkjet printer.

The configuration of the carriage area is described next. FIG. 4 is a diagram showing the configuration of the periphery of the carriage 28 of the inkjet printer.

The inkjet printer shown in FIG. 4 is provided with a paper feed motor (hereinafter referred to as PF motor) 31, which is as an example of the feed mechanism for feeding paper, the carriage 28 to which the print head 36 for ejecting ink, which is an example of a liquid, onto the print paper P is fastened and which is driven in the main-scanning direction, the carriage motor (hereinafter referred to as CR motor) 30 for driving the carriage 28, a linear encoder 11 that is fastened to the carriage 28, a linear encoder code plate 12 in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25.

Figure 5:
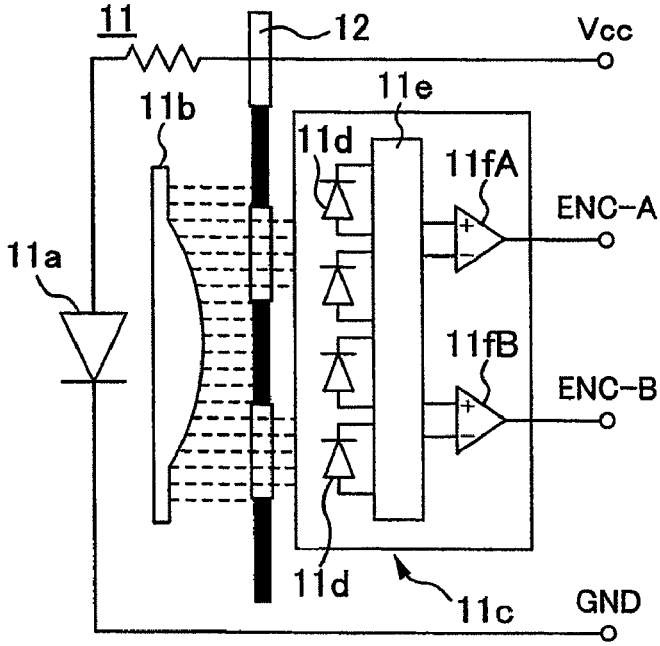
FIG. 5 is an explanatory diagram that schematically shows the configuration of a linear encoder 11 attached to the carriage 28.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens 11*b*, and a detection processing section 11*c*. The detection processing section 11*c* has a plurality of (for example, four) photodiodes 11*d*, a signal processing circuit 11*e*, and for example two comparators 11*f*A and 11*f*B.

The light-emitting diode 11*a* emits light when a voltage Vcc is applied to it via resistors on both ends thereof. This light is condensed into parallel light by the collimating lens 11*b* and passes through the linear encoder code plate 12. The linear encoder code plate 12 is provided with slits at a predetermined spacing (for example, 1/180 inch (one inch=2.54 cm)).

The parallel light that passes through the linear encoder code plate 12 then passes through stationary slits which are not shown and is incident on the photodiodes 11*d*, where it is converted into electric signals. The electric signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulse ENC-A and the pulse ENC-B that are output from the comparators 11*f*A and 11*f*B become the output of the linear encoder 11.

Figure 6:
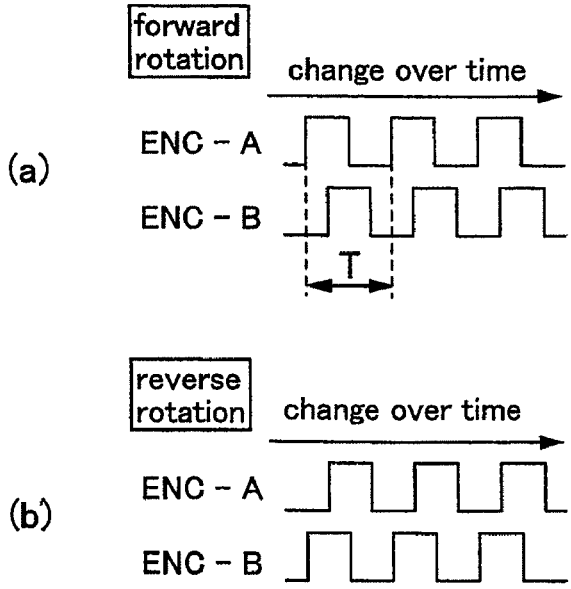
FIG. 6 shows timing charts of the waveforms of the two output signals of the linear encoder 11 when the CR motor is rotating forward and when it is rotating in reverse.

FIG. 6 shows timing charts of the waveforms of the two output signals of the linear encoder 11 for when the CR motor is rotating forward and when it is rotating in reverse.

As shown in FIG. 6(*a*) and FIG. 6(*b*), the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6(*a*), the phase of the pulse ENC-A leads the phase of the pulse ENC-B by 90 degrees, whereas when the CR motor 30 is rotating in reverse, then, as shown in FIG. 6(*b*), the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the linear encoder code plate 12.

The rising edge and the rising edge of the output pulses ENC-A and ENC-B of the linear encoder 11 are detected, and the number of detected edges is counted. The rotational position of the CR motor 30 is detected based on the number that is calculated. With respect to the calculation, when the CR motor 30 is rotating forward a "+1" is added for each detected edge, and when the CR motor 30 is rotating in reverse a "−1" is added for each detected edge. The period of the pulses ENC-A and ENC-B is equal to the time from when one slit of the linear encoder code plate 12 passes through the linear encoder 11 to when the next slit passes through the linear encoder 11, and the phases of the pulse ENC-A and the pulse ENC-B are misaligned by 90 degrees. Accordingly, a count number of "1" of the calculation corresponds to ¼ of the slit spacing of the linear encoder code plate 12. Therefore, if the counted number is multiplied by ¼ of the slit spacing, then the amount that the CR motor 30 has moved from the rotational position corresponding to the count number "0" can be obtained based on this product. The resolution of the linear encoder 11 at this time is ¼ the slit spacing of the linear encoder code plate 12.

On the other hand, the rotary encoder 13 for the PF motor 31 has the same configuration as the linear encoder 11, except that the rotary encoder code plate 14 is a rotation disk that rotates in conjunction with rotation of the PF motor 31. The rotary encoder 13 outputs two output pulses ENC-A and ENC-B, and based on this output the amount of movement of the PF motor 31 can be obtained.

===Example of the Electric Configuration of the Color Inkjet Printer===

Figure 7:
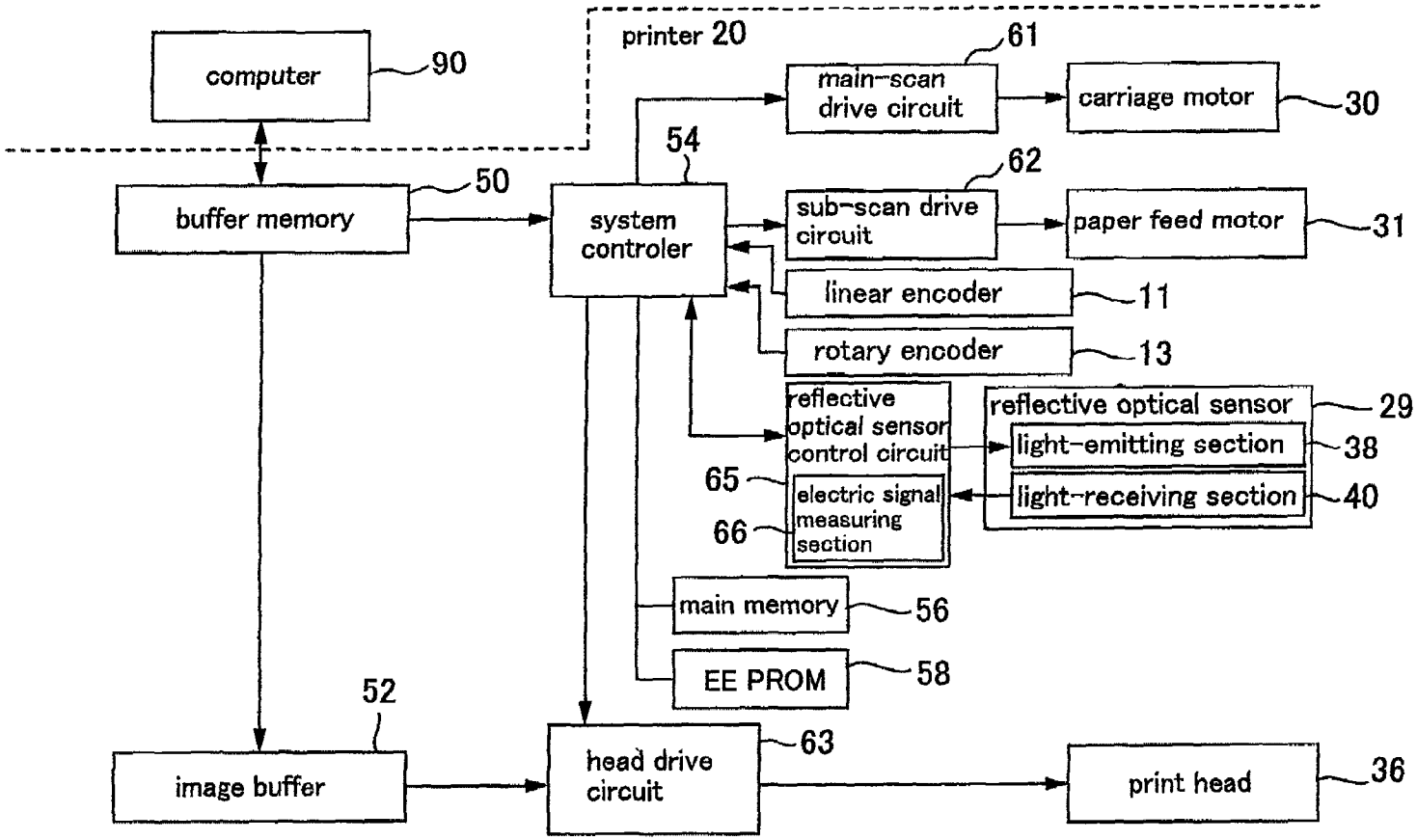
FIG. 7 is a block diagram showing an example of the electrical configuration of the color inkjet printer 20.

FIG. 7 is a block diagram showing an example of the electric configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light-emitting section 38 and the light-receiving section 40 of the reflective optical sensor 29, the above-described linear encoder 11, and the above-described rotary encoder 13. Further, the reflective optical sensor control circuit 65 is provided with an electric signal measuring section 66 for measuring the electric signals that are converted from the reflected light received by the light-receiving section 40.

The print data that are transferred from the computer 90 are held temporarily in the buffer memory 50. Within the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of the various color components from the image buffer 52 in accordance with the control signals from the system controller 54, and drives the nozzle arrays of the respective colors provided in the print head 36 in correspondence with the print data.

===Example of Nozzle Arrangement of Print Head, etc.===

Figure 8:
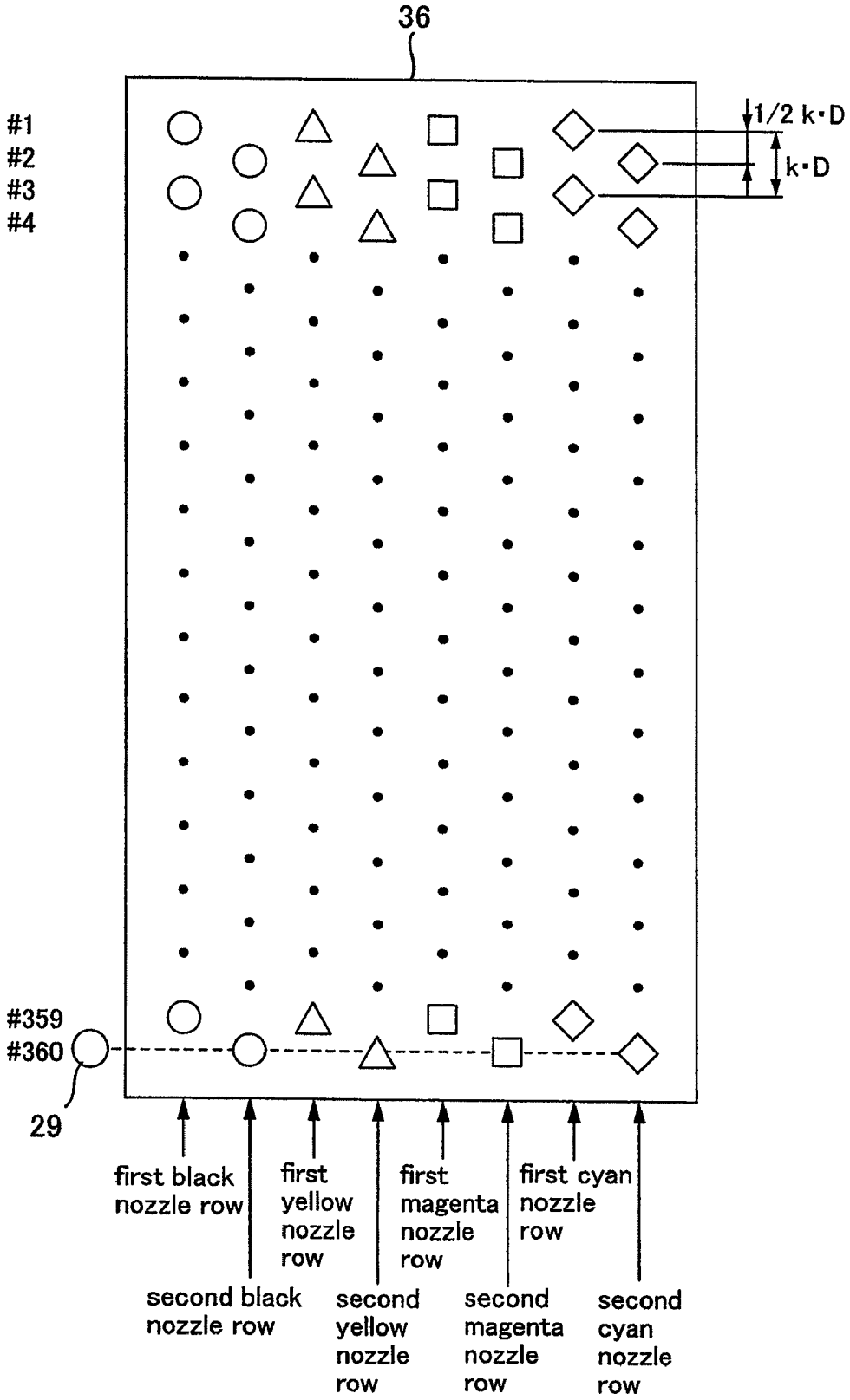
FIG. 8 is an explanatory diagram showing the nozzle arrangement on the bottom surface of the print head 36.

FIG. 8 is an explanatory diagram showing the nozzle arrangement on the bottom surface of the print head 36. The print head 36 has a black nozzle row, a yellow nozzle row, a magenta nozzle row, and a cyan nozzle row, arranged in straight lines in the sub-scanning direction. As shown in the diagram, each of these nozzle rows is constituted by two rows, and in this specification, these nozzle rows are referred to as the first black nozzle row, the second black nozzle row, the first yellow nozzle row, the second yellow nozzle row, the first magenta nozzle row, the second magenta nozzle row, the first cyan nozzle row, and the second cyan nozzle row.

The black nozzle rows (shown by white circles) have 360 nozzles, nozzles #1 to #360. Of these nozzles, the odd-numbered nozzles #1, #3, . . . , #359 belong to the first black nozzle row and the even-numbered nozzles #2, #4, . . . , #360 belong to the second black nozzle row. The nozzles #1, #3, . . . , #359 of the first black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines). Hereafter, the integer k for expressing the nozzle pitch k·D is referred to simply as the "nozzle pitch k." In the example of FIG. 8, the nozzle pitch k is four dots. The nozzle pitch k, however, may be set to any integer.

The nozzles #2, #4, . . . , #360 of the second black nozzle row are also arranged at the constant nozzle pitch k·D (nozzle pitch k=4) in the sub-scanning direction, and as shown in the diagram, the positions of the nozzles in the sub-scanning direction are misaligned with the positions of the nozzles of the first black nozzle row in the sub-scanning direction. In the example of FIG. 8, the amount of this misalignment is ½·k·D (k=4).

The above-described matters also apply for the yellow nozzle rows (shown by white triangles), the magenta nozzle rows (shown by white squares), and the cyan nozzle rows (shown by white diamonds). In other words, each of the these nozzle rows has 360 nozzles #1 to #360, and of the these nozzles, the odd-numbered nozzles #1, #3, . . . , #359 belong to the first nozzle row and the even-numbered nozzles #2, #4, . . . , #360 belong to the second nozzle row. Further, each of these nozzle rows is arranged at a constant nozzle pitch k·D in the sub-scanning direction, and the positions, in the sub-scanning direction, of the nozzles of the second rows are misaligned with respect to the positions, in the sub-scanning direction, of the nozzles of the first rows by ½·k·D (k=4).

In other words, the nozzle groups arranged in the print head 36 are staggered, and during printing, ink droplets are ejected from each of the nozzles while the print head 36 is moved in the main-scanning direction at a constant velocity together with the carriage 28. However, depending on the print mode, not all of the nozzles are always used, and there are instances in which only some of the nozzles are used.

It should be noted that the reflective optical sensor 29 described above is attached to the carriage 28 along with the print head 36. As shown in the figure, in the present embodiment, the position of the reflective optical sensor 29 in the sub-scanning direction matches the position, in the sub-scanning direction, of the nozzle #360 described above.

First Embodiment

Figure 9:
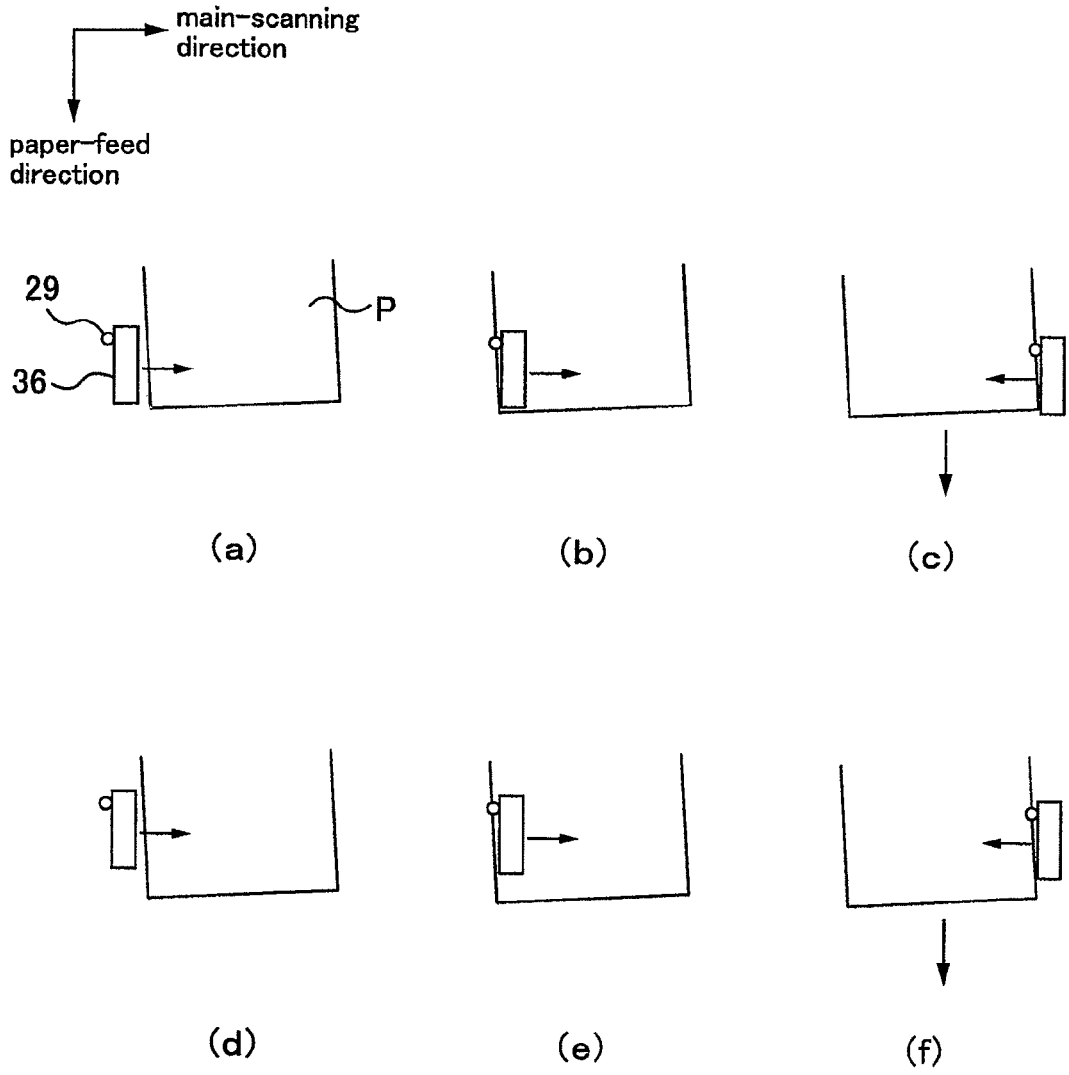
FIG. 9 is a diagram schematically showing the positional relationship among the print head 36, the reflective optical sensor 29, and the print paper P.
Figure 10:
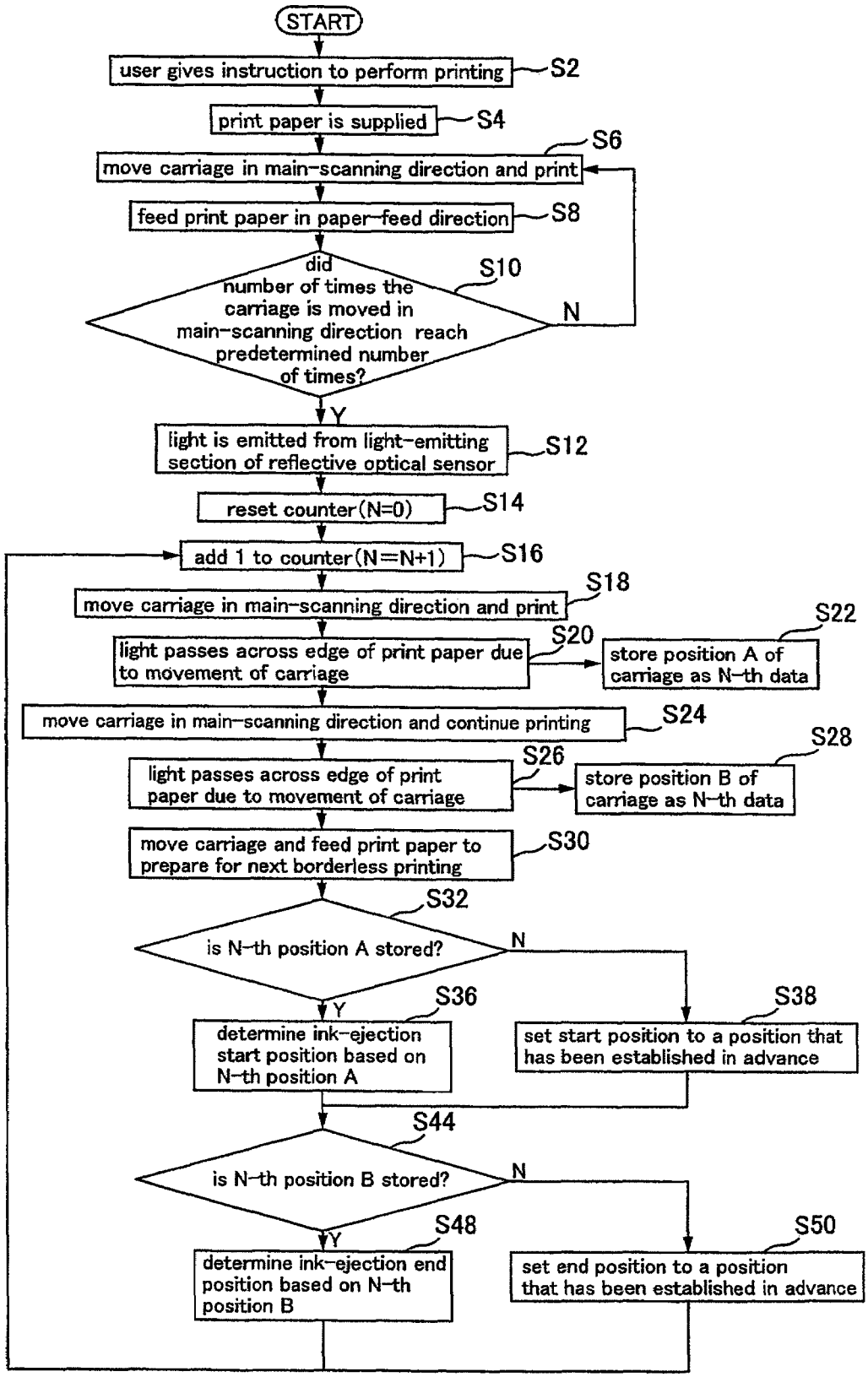
FIG. 10 is a flowchart for describing the first embodiment.

Next, a first embodiment of the present invention is described using FIG. 9 and FIG. 10. FIG. 9 is a diagram schematically showing the positional relationship among the print head 36, the reflective optical sensor 29, and the print paper P. FIG. 10 is a flowchart for describing the first embodiment.

First, the user gives a command to perform printing through the application program 95 or the like (step S2). The application program 95 receives this instruction and issues a print command. Accordingly, the printer driver 96 of the computer 90 receives image data from the application program 95 and converts them to print data PD including raster data indicating the state in which dots are formed during main scan and data indicating the sub-scan feed amount. Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also designate the size of the print paper P or issue a command to perform borderless printing to the user interface display module 101. This instruction by the user is received by the user interface display module 101 and sent to the UI printer interface module 102. The UI printer interface module 102 interprets the instruction that has been given, and sends a command COM to the color inkjet printer 20. The color inkjet printer 20 receives the command COM at the buffer memory 50 and then transmits it to the system controller 54.

The color inkjet printer 20 then drives, for example, the paper feed motor 31 by the sub-scan drive circuit 62 based on the command that is sent to the system controller 54 so as to supply the print paper P (step S4).

Then, the system controller 54 moves the carriage 28 in the main-scanning direction as it feeds the print paper P in the paper-feed direction, and ejects ink from the print head 36 provided in the carriage 28, thereby carrying out borderless printing (step S6, step S8). It should be noted that the print paper P is fed in the paper-feed direction by driving the paper feed motor 31 with the sub-scan drive circuit 62, the carriage 28 is moved in the main-scanning direction by driving the carriage motor 30 with the main-scan drive circuit 61, and ink is ejected from the print head 36 by driving the print head 36 with the head drive circuit 63.

The color inkjet printer 20 carries out the operations of step S6 and step S8 continuously, and if, for example, the number of times the carriage 28 is moved in the main-scanning direction reaches a predetermined number of times (step S10), then, from the next move of the carriage 28 in the main-scanning direction, the following operation is performed.

The system controller 54 controls the reflective optical sensor 29, which is provided in the carriage 28, by the reflective optical sensor control circuit 65, so that light is emitted toward the platen 26 from the light-emitting section 38 of the reflective optical sensor 29 (step S12).

A counter (not shown) for counting the series of operations that are repeated as described below is provided, and the system controller 54 resets the counter (step S14). Resetting is achieved, for example, by setting the counter value N to zero. Next, the system controller 54 adds one (1) to the counter value N (step S16), and as shown in FIG. 9(*a*) and FIG. 9(*b*), it makes the main-scan drive circuit 61 drive the CR motor 30 to move the carriage 28, in order to eject ink from the print head 36 provided in the carriage 28 and perform borderless printing (step S18). Eventually, as shown in FIG. 9(*b*), the light that is emitted from the light-emitting section 38 passes across the edge of the print paper P (step S20). At this time, the object on which the light that is emitted from the light-emitting section 38 is incident changes from the platen 26 to the print paper P, and thus the intensity of the electric signal, that is, the value output by the light-receiving section 40 of the reflective optical sensor 29 that receives the reflected light, is changed. Then, by measuring the intensity of this electric signal with the electric signal measuring section 66, the fact that the light has passed the edge of the print paper P is detected.

Then, the amount of movement of the CR motor 30 from the reference position is obtained based on the output pulses of the linear encoder 11, and this amount of movement, in other words, the position of the carriage 28 (below, this position is referred to also as position A) is stored as the N-th data (step S22).

As shown in FIG. 9(*b*) and FIG. 9(*c*), also after the above-described step S16 and step S18, the system controller 54 moves the carriage 28 and ejects the ink from the print head 36 provided in the carriage 28 to perform borderless printing (step S24).

Eventually, as shown in FIG. 9(*c*), the light that is emitted from the light-emitting section 38 passes across the edge of the print paper P (which is an edge whose position in the main-scanning direction is different from that of the edge passed in step S20) (step S26). At this time, the object on which the light that is emitted from the light-emitting section 38 is incident changes from the print paper P to the platen 26, and thus the intensity of the electric signal, that is, the value output by the light-receiving section 40 of the reflective optical sensor 29 that receives the light that is reflected, is changed. Then, by measuring the intensity of this electric signal with the electric signal measuring section 66, the fact that the light has passed the edge of the print paper P is detected.

Then, the amount of movement of the CR motor 30 from the reference position is obtained based on the output pulses of the linear encoder 11, and this amount of movement, in other words, the position of the carriage 28 (below, this position is referred to also as position B) is stored as the N-th data (step S28).

Next, as shown in FIG. 9(*c*) and FIG. 9(*d*), the system controller 54 drives the CR motor 30 to move the carriage 28, and also drives the paper feed motor 31 to feed the print paper P by a predetermined amount, thereby preparing for the next borderless printing (step S30).

Next, as shown in FIG. 9(*d*) and FIG. 9(*e*), the system controller 54 makes the main-scan drive circuit 61 drive the CR motor 30 to move the carriage 28 in order to eject ink from the print head 36 provided in the carriage 28 and perform borderless printing (step S18); however, before this operation, the system controller 54 determines the ink-ejection start position and the ink-ejection end position of the print head 36 (step S32 through step S50). The method of determining the ink-ejection start position and the ink-ejection end position will be described further below.

Next, the procedure returns to step S16; the system controller 54 adds one (1) to the counter value N (step S16), and then, as shown in FIG. 9(*d*), FIG. 9(*e*), and FIG. 9(*f*), the above-described procedure from step S18 to step S50 is carried out. During this procedure, the system controller 54 controls the head drive circuit 63 to start ejection of ink from the ink-ejection start position that has been determined and to end ejection of ink at the ink-ejection end position that has been determined.

The procedure from this point onward is a repetition of from step S16 to step S50, as shown by the loop structure in the flowchart of FIG. 10.

Figure 11:
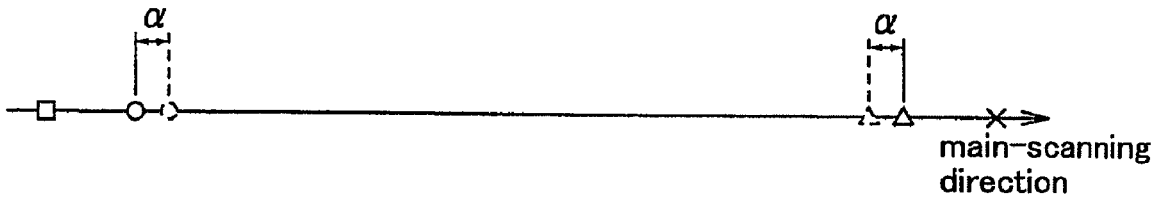
FIG. 11 is a explanatory diagram for describing the method of finding an ink-ejection start position and an ink-ejection end position.

Next, an example of a method of determining the ink-ejection start position and the ink-ejection end position is described using FIG. 11 and with reference to FIG. 10. FIG. 11 is an explanatory diagram for describing a method of determining the ink-ejection start position and the ink-ejection end position.

First, the system controller 54 determines whether the position of the edge of the print paper P was detected in step S20 and step S22. For example, the system controller 54 reads in the data from a storage region corresponding to the N-th position A, and makes the determination based on the data that has been read in (step S32).

If the position of the edge of the print paper P has been detected (for example, if the N-th position A has been stored), then the position where ink ejection is to be started is determined based on this N-th position A (which is indicated by a dotted-line circle in FIG. 11) (step S36). For example, as shown in FIG. 11, the position where ink ejection is to be started is determined, allowing for a margin with a distance α from the N-th position A (this position is indicated by a solid-line circle in FIG. 11).

On the other hand, if the position of the edge of the print paper P was not detected (for example, if the N-th position A has not been stored) due, for example, to malfunction of the reflective optical sensor 29, then a position that has been established in advance independent of the N-th position A is adopted as the ink-ejection start position (this position is indicated by a square in FIG. 11) (step S38).

In the same way, the system controller 54 determines whether the position of the edge of the print paper P was detected in step S26 and step S28. For example, the system controller 54 reads in the data from a storage region corresponding to the N-th position B, and makes the determination based on the data that has been read in (step S44).

If the position of the edge of the print paper P has been detected (for example, if the N-th position B has been stored), then the position where ink ejection is to be ended is determined based on this N-th position B (which is indicated by a dotted-line triangle in FIG. 11) (step S48). For example, as shown in FIG. 11, the position where ink ejection is to be ended is determined, allowing for a margin with a distance α from the N-th position B (this position is indicated by a solid-line triangle in FIG. 11).

On the other hand, if the position of the edge of the print paper P was not detected (for example, if the N-th position B has not been stored) due, for example, to malfunction of the reflective optical sensor 29, then a position that has been established in advance independent of the N-th position B is adopted as the ink-ejection end position (this position is indicated by an X in FIG. 11) (step S50).

It should be noted that the margin α is set based, for example, on a detection error that occurs during detection of the edge of the print paper P, such that no unnecessary blank space is created on the print paper P. Further, in the above description, the value of the margin α was the same for when determining the start position and for when determining the end position. However, different values may be set.

Furthermore, it is preferable to set the start position and the end position that are established in advance to include a sufficient margin, while taking into consideration the fact that no unnecessary blank space should be created on the print paper P. For example, it is possible to adopt the start position and the end position of the print data, which includes a certain amount of margin with respect to the size of the print paper as described in the section of the Background Art, as the start position and the end position that are established in advance.

Furthermore, a program for carrying out the processes described above is stored in the EEPROM 58, and this program is executed by the system controller 54.

As described in the section of the Background Art, in order to eliminate the problem that ink is uselessly consumed by performing printing on a region outside the print paper, it is advantageous to adopt a method of detecting the position of the edge of the print paper and changing the start position and/or the end position for ejecting ink in accordance with the detected edge position. However, in carrying out this method, situations may occur in which the position of the edge of the print paper is not detected due to some reason. In such a situation, if the start position and/or the end position for ejecting ink is determined simply by using information about the position of an edge that was previously detected, instead of information about the position of the relevant edge, without changing the way of determining the start position and/or the end position for ejecting ink, then a problem that a blank space is unintentionally created on the print paper may arise.

More specifically, the position of the edge that should have been detected and the position of an edge that was previously detected may significantly differ due to the print paper being supplied in a slanted (skewed) manner, and therefore, the above-described problem may arise if the start position and/or the end position is determined simply by using information about the position of an edge that was previously detected without changing the way of determining the start position and/or the end position for ejecting ink.

In view of this, by setting the start position or the end position to a position that has been established in advance in a case where the edge position was not detected as described above, it becomes possible to prevent a blank space from unintentionally being created on the print paper.

Second Embodiment

Figure 12:
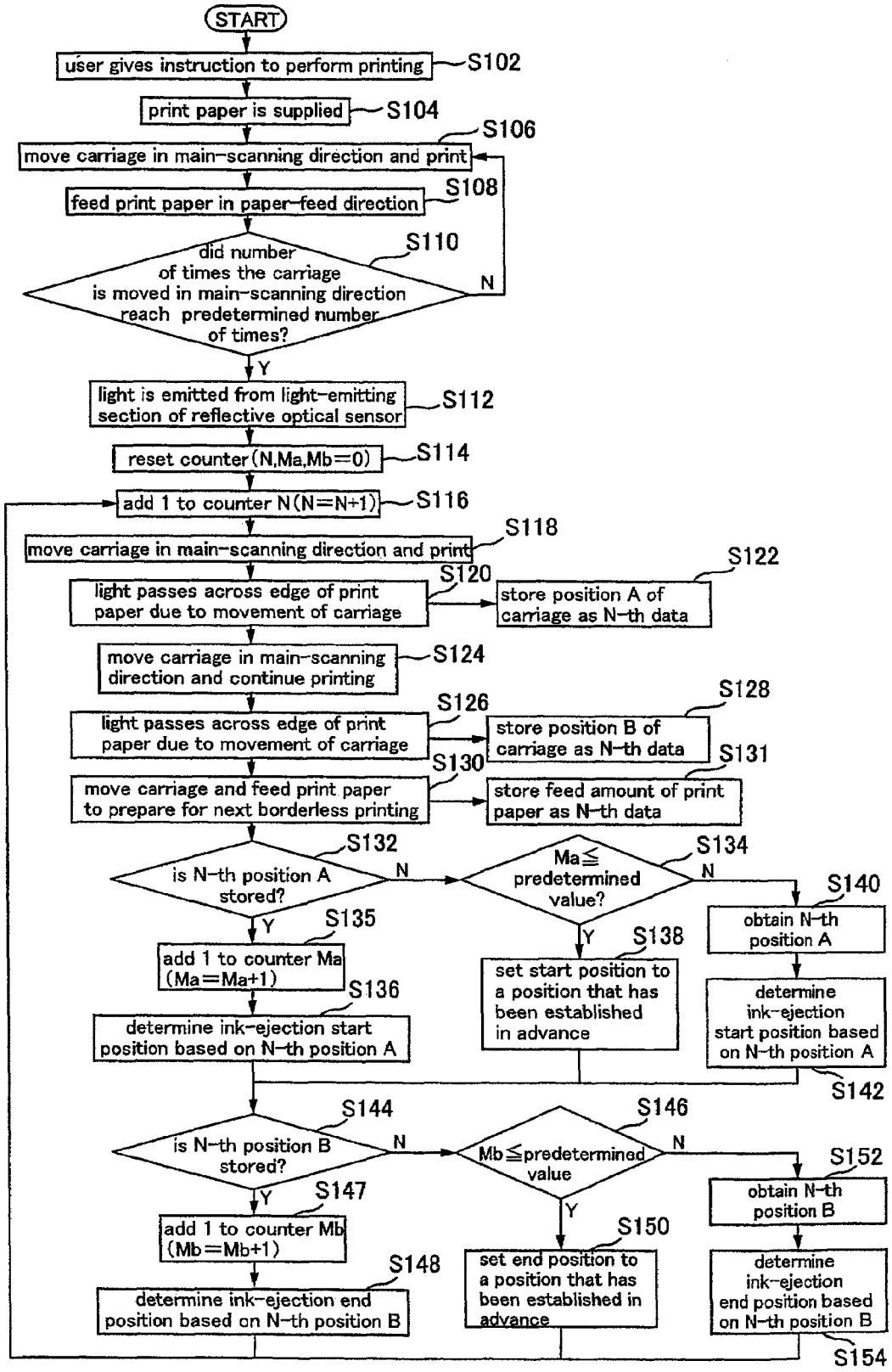
FIG. 12 is a flowchart for describing a second embodiment.

Next, a second embodiment of the present invention is described using FIG. 12 and with reference to FIG. 9. FIG. 12 is a flowchart for describing the second embodiment.

The present flowchart starts from the point where the user first gives an instruction to perform printing in the application program 95 etc. (step S102). The procedure from this point up to step S130 is the same as that of from step S2 to step S30 described in the first embodiment.

In step S130, as shown in FIG. 9(*c*) and FIG. 9(*d*), the system controller 54 drives the CR motor 30 to move the carriage 28, and also drives the paper feed motor 31 to feed the print paper P by a predetermined amount, thereby preparing for the next borderless printing. At this time, the system controller 54 obtains the amount of movement of the PF motor 31 from the reference position based on the output pulses of the rotary encoder 13, and stores this amount of movement, in other words, the amount by which the print paper P was fed (step S131).

Next, as shown in FIG. 9(*d*) and FIG. 9(*e*), the system controller 54 makes the main-scan drive circuit 61 drive the CR motor 30 to move the carriage 28 in order to eject ink from the print head 36 provided in the carriage 28 and perform borderless printing (step S118); however, before this operation, the system controller 54 determines the ink-ejection start position and the ink-ejection end position of the print head 36 (step S132 through step S154). The method of determining the ink-ejection start position and the ink-ejection end position will be described further below.

Next, the procedure returns to step S116; the system controller 54 adds one (1) to the counter value N (step S116), and then, as shown in FIG. 9(*d*), FIG. 9(*e*), and FIG. 9(*f*), the above-described procedure from step S118 to step S154 is carried out. During this procedure, the system controller 54 controls the head drive circuit 63 to start ejection of ink from the ink-ejection start position that has been determined and to end ejection of ink at the ink-ejection end position that has been determined.

The procedure from this point onward is a repetition of from step S116 to step S154, as shown by the loop structure in the flowchart of FIG. 12.

Next, an example of a method of determining the ink-ejection start position and the ink-ejection end position is described with reference to FIG. 11 and FIG. 12.

First, the system controller 54 determines whether the position of the edge of the print paper P was detected in step S120 and step S122. For example, the system controller 54 reads in the data from a storage region corresponding to the N-th position A, and makes the determination based on the data that has been read in (step S132).

If the position of the edge of the print paper P has been detected (for example, if the N-th position A has been stored), then the position where ink ejection is to be started is determined based on this N-th position A (which is indicated by a dotted-line circle in FIG. 11) (step S136). For example, as shown in FIG. 11, the position where ink ejection is to be started is determined, allowing for a margin with a distance $\alpha$ from the N-th position A (this position is indicated by a solid-line circle in FIG. 11).

On the other hand, if the position of the edge of the print paper P was not detected (for example, if the N-th position A has not been stored) due, for example, to malfunction of the reflective optical sensor 29, then the position of the edge that was not detected is obtained from positions of two edges that were detected in the past and an amount by which the print paper was fed from when the positions of the edges were detected, and the position where ink ejection is to be started is determined based on the edge position that has been obtained.

This is described in more detail by giving an example. If the position of the edge of the print paper P was not detected (if the N-th position A was not stored in step S122), then first, the position of the edge that was not detected is obtained from positions of two edges that were detected in the past and an amount by which the print paper was fed from when the positions of the edges were detected (step S140). For example, it is assumed that: the N-2-th position A and the N-1-th position A have been stored; the N-2-th position A, the N-1-th position A, and the N-th position A that was not stored are expressed, respectively, as Xan-2, Xan-1, and Xan; and the N-3-th feed amount, the N-2-th feed amount, and the N-1-th feed amount of print paper that were stored in step S131 are expressed, respectively, as Pn-3, Pn-2, and Pn-1. Here, Xan, which is the N-th position A that was not stored, is obtained from the relationship (Xan−Xan-1)/(Xan−Xan-2)=(Pn-1−Pn-2)/(Pn -1−Pn-3). That is, arranging this equation obtains Xan=((Pn-1−Pn-3)·Xan-1−(Pn-1−Pn-2)·Xan-2)/(Pn -2−Pn-3), and thus, it is possible to obtain Xan from the known values Xan-2, Xan-1, Pn-3, Pn-2, and Pn-1.

Then, based on the N-th position A that has been obtained (which is indicated by the dotted-line circle in FIG. 11), the position where ink ejection is to be started is determined (step S142). For example, as shown in FIG. 11, the position where ink ejection is to be started is determined, allowing for a margin with a distance $\alpha$ from the N-th position A (this position is indicated by the solid-line circle in FIG. 11).

In the same way, the system controller 54 determines whether the position of the edge of the print paper P was detected in step S126 and step S128. For example, the system controller 54 reads in the data from a storage region corresponding to the N-th position B, and makes the determination based on the data that has been read in (step S144).

If the position of the edge of the print paper P has been detected (for example, if the N-th position B has been stored), then the position where ink ejection is to be ended is determined based on this N-th position B (which is indicated by a dotted-line triangle in FIG. 11) (step S148). For example, as shown in FIG. 11, the position where ink ejection is to be ended is determined, allowing for a margin with a distance $\alpha$ from the N-th position B (this position is indicated by a solid-line triangle in FIG. 11).

On the other hand, if the position of the edge of the print paper P was not detected (for example, if the N-th position B has not been stored) due, for example, to malfunction of the reflective optical sensor 29, then the position of the edge that was not detected is obtained from positions of two edges that were detected in the past and an amount by which the print paper was fed from when the positions of the edges were detected, and the position where ink ejection is to be ended is determined based on the edge position that has been obtained.

This is described in more detail by giving an example. If the position of the edge of the print paper P was not detected (if the N-th position B was not stored in step S128), then first, the position of the edge that was not detected is obtained from positions of two edges that were detected in the past and an amount by which the print paper was fed from when the positions of the edges were detected (step S152). For example, it is assumed that: the N-2-th position B and the N-1-th position B have been stored; the N-2-th position B, the N-1-th position B, and the N-th position B that was not stored are expressed, respectively, as Xbn-2, Xbn-1, and Xbn; and the N-3-th feed amount, the N-2-th feed amount, and the N-1-th feed amount of print paper that were stored in step S131 are expressed, respectively, as Pn-3, Pn-2, and Pn-1. Here, Xbn, which is the N-th position B that was not stored, is obtained from the relationship (Xbn−Xbn-1)/(Xbn−Xbn-2)=(Pn-1−Pn-2)/(Pn-1−Pn-3). That is, arranging this equation obtains Xbn=((Pn-1−Pn-3)·Xbn-1−(Pn-1−Pn-2)·Xbn-2)/(Pn-2−Pn-3), and thus, it is possible to obtain Xn from the known values Xbn-2, Xbn-1, Pn-3, Pn-2, and Pn-1.

Then, based on the N-th position B that has been obtained (which is indicated by the dotted-line triangle in FIG. 11), the position where ink ejection is to be ended is determined (step S142). For example, as shown in FIG. 11, the position where ink ejection is to be ended is determined, allowing for a margin with a distance α from the N-th position B (this position is indicated by the solid-line triangle in FIG. 11).

Next, another example of a method of obtaining the ink-ejection start position and the ink-ejection end position is described with reference to FIG. 11 and FIG. 12.

In the previous description, if the position of the edge of the print paper P was not detected (for example, if the N-th position A has not been stored) due, for example, to malfunction of the reflective optical sensor 29, then the position of the edge that was not detected was obtained from positions of two edges that were detected in the past and an amount by which the print paper was fed from when the positions of the edges were detected, and the position where ink ejection is to be started was determined based on the edge position that has been obtained. In place of the above-described method, the position of the edge that was not detected is obtained from a position of a single edge that was detected in the past, an amount by which the print paper was fed from when the position of that edge was detected, and a predicted maximum skew angle of the print paper, and the position where ink ejection is to be started is determined based on the edge position that has been obtained.

This is described in more detail by giving an example. If the position of the edge of the print paper P was not detected (if the N-th position A was not stored in step S122), then first, the position of the edge that was not detected is instead obtained from a position of a single edge that was detected in the past, an amount by which the print paper was fed from when the position of that edge was detected, and a predicted maximum skew angle of the print paper (step S140). For example, it is assumed that: the N-1-th position A has been stored; the N-1-th position A and the N-th position A that was not stored are expressed, respectively, as Xan-1 and Xan; the N-2-th feed amount and the N-1-th feed amount of print paper that were stored in step S131 are expressed, respectively, as Pn-2 and Pn-1; and the predicted maximum skew angle of the print paper is θ. Here, Xan, which is the N-th position A that was not stored, is obtained from the relationship (Xan−Xan-1)/(Pn-1−Pn-2)=tan θ. That is, arranging this equation obtains Xan=Xan-1+(Pn-1−Pn-2)·tan θ, and thus, it is possible to obtain Xan from the known values Xan-1, Pn-2, Pn-1, and θ.

Then, based on the N-th position A that has been obtained (which is indicated by the dotted-line circle in FIG. 11), the position where ink ejection is to be started is determined (step S142). For example, as shown in FIG. 11, the position where ink ejection is to be started is determined, allowing for a margin with a distance α from the N-th position A (this position is indicated by the solid-line circle in FIG. 11).

Similarly, in the previous description, if the position of the edge of the print paper P was not detected (for example, if the N-th position B has not been stored) due, for example, to malfunction of the reflective optical sensor 29, then the position of the edge that was not detected was obtained from positions of two edges that were detected in the past and an amount by which the print paper was fed from when the positions of the edges were detected, and the position where ink ejection is to be ended was determined based on the edge position that has been obtained. In place of the above-described method, the position of the edge that was not detected is obtained from a position of a single edge that was detected in the past, an amount by which the print paper was fed from when the position of that edge was detected, and a predicted maximum skew angle of the print paper, and the position where ink ejection is to be ended is determined based on the edge position that has been obtained.

This is described in more detail by giving an example. If the position of the edge of the print paper P was not detected (if the N-th position B was not stored in step S128), then first, the position of the edge that was not detected is instead obtained from a position of a single edge that was detected in the past, an amount by which the print paper was fed from when the position of that edge was detected, and a predicted maximum skew angle of the print paper (step S152). For example, it is assumed that: the N-1-th position B has been stored; the N-1-th position B and the N-th position B that was not stored are expressed, respectively, as Xbn-1 and Xbn; the N-2-th feed amount and the N-1-th feed amount of print paper that were stored in step S131 are expressed, respectively, as Pn-2 and Pn-1; and the predicted maximum skew angle of the print paper is θ. Here, Xbn, which is the N-th position B that was not stored, is obtained from the relationship (Xbn−Xbn-1)/(Pn-1−Pn-2)=tan θ. That is, arranging this equation obtains Xbn=Xbn-1+(Pn-1−Pn-2)·tan θ, and thus, it is possible to obtain Xbn from the known values Xbn-1, Pn-2, Pn-1, and θ.

Then, based on the N-th position B that has been obtained (which is indicated by the dotted-line triangle in FIG. 11), the position where ink ejection is to be ended is determined (step S154). For example, as shown in FIG. 11, the position where ink ejection is to be ended is determined, allowing for a margin with a distance α from the N-th position B (this position is indicated by the solid-line triangle in FIG. 11).

It should be noted that in the above description, the margin α is set based, for example, on a detection error that occurs during detection of the edge of the print paper P, such that no unnecessary blank space is created on the print paper P. Further, in the above description, the value of the margin α was the same for when determining the start position and for when determining the end position. However, different values may be set.

Further, in the above description, the N-1-th position A or B and the N-2-th position A or B in the former method, and the N-1-th position A or B in the latter method, were used for obtaining the N-th position A or B. The positions, however, are not limited to the above, as long as they are positions A or B that have been detected in the past.

Further, in the above description, since two positions A or B that were detected in the past in the former method, and one position A or B that was detected in the past in the latter method, are used for obtaining the N-th position A or B, it is instead possible to adopted a position that has been established in advance as the ink-ejection start position (which is indicated by a square in FIG. 11) and/or the end position (which is indicated by an X in FIG. 11), as described in the section of the first embodiment, while information regarding these positions in the past has not yet been obtained sufficiently (step S134, step S135, step S138, step S146, step S147, and step S150). Furthermore, it is preferable to set the start position and the end position that are established in advance to include a sufficient margin, while taking into consideration the fact that no unnecessary blank space should be created on the print paper P. For example, it is possible to adopt the start position and the end position of the print data, which includes a certain amount of margin with respect to the size of the print paper as described in the section of the Background Art, as the start position and the end position that are established in advance.

Further, the maximum skew angle of the print paper described above may be set by predicting the maximum angle at which the print paper may skew based on, for example, information regarding the structure, mechanisms, etc. of the printing apparatus.

Furthermore, a program for carrying out the processes described above is stored in the EEPROM 58, and this program is executed by the system controller 54.

As described in the section of the Background Art, in order to eliminate the problem that ink is uselessly consumed by performing printing on a region outside the print paper, it is advantageous to adopt a method of detecting the position of the edge of the print paper and changing the start position and/or the end position for ejecting ink in accordance with the detected edge position. However, in carrying out this method, situations may occur in which the position of the edge of the print paper is not detected due to some reason. In such a situation, if the start position and/or the end position for ejecting ink is determined simply by using information about the position of an edge that was previously detected, instead of information about the position of the relevant edge, without changing the way of determining the start position and/or the end position for ejecting ink, then a problem that a blank space is unintentionally created on the print paper may arise. More specifically, the position of the edge that should have been detected and the position of an edge that was previously detected may significantly differ due to the print paper being supplied in a slanted (skewed) manner, and therefore, the above-described problem may arise if the start position and/or the end position is determined simply by using information about the position of an edge that was previously detected without changing the way of determining the start position and/or the end position for ejecting ink.

In view of this, by determining the start position or the end position based on a position of an end that was detected in the past according to such a method as described above in a case where the edge position was not detected, it becomes possible to prevent a blank space from unintentionally being created on the print paper.

It should be noted that in the foregoing embodiment, a method of determining the start position or the end position based on a plurality of positions of the edge that were detected in the past in a case where the position of the edge of the print paper was not detected was described as the former method. Further, a method of determining the start position or the end position based on a single position of the edge that was detected in the past and a predicted maximum skew angle of the print paper in a case where the position of the edge of the print paper was not detected was described as the latter method. These, however, are not limitations.

The foregoing embodiment, however, is more preferable because in the former method, it is possible to determine an appropriate start position or end position more accurately, and because in the latter method, it is possible to determine the start position or the end position from minimum information regarding the position of the edge that was detected in the past.

Further, as regards the former method, in the foregoing embodiment, the position of the edge that was not detected was obtained from the plurality of positions of the edge that were detected in the past, and the start position or the end position was determined based on the position of the edge that has been obtained, in a case where the position of the edge was not detected. This, however, is not a limitation. For example, the start position or the end position may be determined directly from the plurality of positions of the edge that were detected in the past, without obtaining the position of the edge that was not detected.

The foregoing embodiment, however, is more preferable because in this way, it is possible to determine the start position or the end position more easily.

Further, as regards the former method, in the foregoing embodiment, the position of the edge that was not detected was obtained from two positions of the edge that were detected in the past, and the start position or the end position was determined based on the position of the edge that has been obtained, in a case where the position of the edge was not detected. This, however, is not a limitation. For example, the position of the edge that was not detected may be obtained from three or more positions of the edge that were detected in the past.

The foregoing embodiment, however, is more preferable because in this way, it is possible to determine the start position or the end position from minimum information regarding the positions of the edge that were detected in the past.

Further, as regards the former method, in the foregoing embodiment, the position of the edge that was not detected was obtained from the plurality of positions of the edge that were detected in the past and a feed amount by which the print paper was fed from when the positions of the edge were detected, and the start position or the end position was determined based on the position of the edge that has been obtained, in a case where the position of the edge was not detected. This, however, is not a limitation.

The foregoing embodiment, however, is more preferable because, by using information about the feed amount of the print paper to obtain the position of the edge that was not detected, it is possible to determine an appropriate start position or end position more accurately.

Further, as regards the latter method, in the foregoing embodiment, the position of the edge that was not detected was obtained from the single position of the edge that was detected in the past and the predicted maximum skew angle of the print paper, and the start position or the end position was determined based on the position of the edge that has been obtained, in a case where the position of the edge was not detected. This, however, is not a limitation. For example, the start position or the end position may be determined directly from the single position of the edge that was detected in the past and the predicted maximum skew angle of the print paper, without obtaining the position of the edge that was not detected.

The foregoing embodiment, however, is more preferable because in this way, it is possible to determine the start position or the end position more easily.

Further, as regards the latter method, in the foregoing embodiment, the position of the edge that was not detected was obtained from the single position of the edge that was detected in the past, a feed amount by which the print paper was fed from when the position of the edge was detected, and the predicted maximum skew angle of the print paper, and the start position or the end position was determined based on the position of the edge that has been obtained, in a case where the position of the edge was not detected. This, however, is not a limitation.

The foregoing embodiment, however, is more preferable because, by using information about the feed amount of the print paper to obtain the position of the edge that was not detected, it is possible to determine an appropriate start position or end position more accurately.

Third Embodiment

Figure 13:
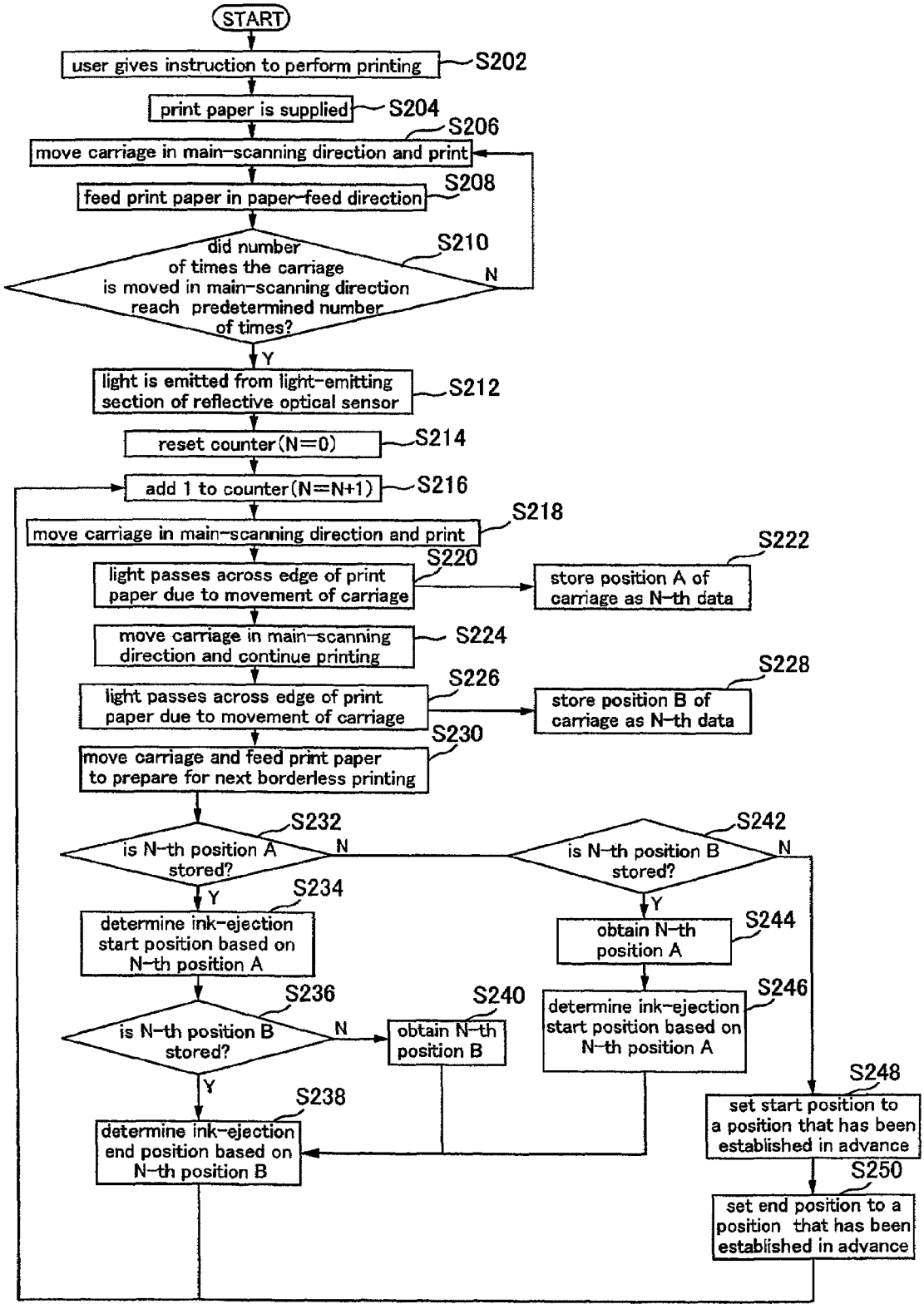
FIG. 13 is a flowchart for describing a third embodiment.

Next, a third embodiment of the present invention is described using FIG. 13 and with reference to FIG. 9. FIG. 13 is a flowchart for describing the third embodiment.

The present flowchart starts from the point where the user first gives an instruction to perform printing in the application program 95 etc. (step S202). The procedure from this point up to step S230 is the same as that of from step S2 to step S30 described in the first embodiment.

In step S230, as shown in FIG. 9(*c*) and FIG. 9(*d*), the system controller 54 drives the CR motor 30 to move the carriage 28, and also drives the paper feed motor 31 to feed the print paper P by a predetermined amount, thereby preparing for the next borderless printing. Then, as shown in FIG. 9(*d*) and FIG. 9(*e*), the system controller 54 makes the main-scan drive circuit 61 drive the CR motor 30 to move the carriage 28 in order to eject ink from the print head 36 provided in the carriage 28 and perform borderless printing (step S218); however, before this operation, the system controller 54 determines the ink-ejection start position and the ink-ejection end position of the print head 36 (step S232 through step S250). The method of determining the ink-ejection start position and the ink-ejection end position will be described further below.

Next, the procedure returns to step S216; the system controller 54 adds one (1) to the counter value N (step S216), and then, as shown in FIG. 9(*d*), FIG. 9(*e*), and FIG. 9(*f*), the above-described procedure from step S218 to step S250 is carried out. During this procedure, the system controller 54 controls the head drive circuit 63 to start ejection of ink from the ink-ejection start position that has been determined and to end ejection of ink at the ink-ejection end position that has been determined.

The procedure from this point onward is a repetition of from step S216 to step S250, as shown by the loop structure in the flowchart of FIG. 13.

Next, an example of a method of determining the ink-ejection start position and the ink-ejection end position is described with reference to FIG. 11 and FIG. 13.

First, the system controller 54 determines whether the position of the edge of the print paper P was detected in step S220 and step S222. For example, the system controller 54 reads in the data from a storage region corresponding to the N-th position A, and makes the determination based on the data that has been read in (step S232).

If the position of the edge of the print paper P has been detected (for example, if the N-th position A has been stored), then the position where ink ejection is to be started is determined based on this N-th position A (which is indicated by a dotted-line circle in FIG. 11) (step S234). For example, as shown in FIG. 11, the position where ink ejection is to be started is determined, allowing for a margin with a distance $\alpha$ from the N-th position A (this position is indicated by a solid-line circle in FIG. 11).

Next, the system controller 54 determines whether the position of the edge of the print paper P was detected in step S226 and step S228. For example, the system controller 54 reads in the data from a storage region corresponding to the N-th position B, and makes the determination based on the data that has been read in (step S236).

If the position of the edge of the print paper P has been detected (for example, if the N-th position B has been stored), then the position where ink ejection is to be ended is determined based on this N-th position B (which is indicated by a dotted-line triangle in FIG. 11) (step S238). For example, as shown in FIG. 11, the position where ink ejection is to be ended is determined, allowing for a margin with a distance $\alpha$ from the N-th position B (this position is indicated by a solid-line triangle in FIG. 11).

On the other hand, if the position of the edge of the print paper P was not detected (for example, if the N-th position B has not been stored) due, for example, to malfunction of the reflective optical sensor 29, then the position of the edge that was not detected is obtained from the N-th position A that has been detected and the width of the print paper, and the position where ink ejection is to be ended is determined based on the edge position that has been obtained.

More specifically, if the position of the edge of the print paper P was not detected (if the N-th position B was not stored in step S228), then first, the position of the edge that was not detected is obtained from the N-th position A that has been detected and the width of the print paper (step S240). For example, the N-th position B is obtained by adding the width of the print paper to the N-th position A that has been detected.

Then, based on the N-th position B that has been obtained (which is indicated by the dotted-line triangle in FIG. 11), the position where ink ejection is to be ended is determined (step S238). For example, as shown in FIG. 11, the position where ink ejection is to be ended is determined, allowing for a margin with a distance $\alpha$ from the N-th position B (this position is indicated by the solid-line triangle in FIG. 11).

Further, if, in step S232, the position of the edge of the print paper P was not detected (for example, if the N-th position A has not been stored) due, for example, to malfunction of the reflective optical sensor 29, then the system controller 54 determines whether the position of the edge of the print paper P was detected in step S226 and step S228. For example, the system controller 54 reads in the data from a storage region corresponding to the N-th position B, and makes the determination based on the data that has been read in (step S242).

If the position of the edge of the print paper P has been detected (for example, if the N-th position B has been stored), then the N-th position A that was not detected is obtained from the N-th position B that has been detected and the width of the print paper, and the position where ink ejection is to be started is determined based on the edge position that has been obtained.

More specifically, first, the N-th position A that was not detected is obtained from the N-th position B that has been detected and the width of the print paper (step S244). For example, the N-th position A is obtained by subtracting the width of the print paper from the N-th position B that has been detected.

Then, based on the N-th position A that has been obtained (which is indicated by the dotted-line circle in FIG. 11), the position where ink ejection is to be started is determined (step S246). For example, as shown in FIG. 11, the position where ink ejection is to be started is determined, allowing for a margin with a distance α from the N-th position A (this position is indicated by the solid-line circle in FIG. 11).

Next, the position where ink ejection is to be ended is determined based on the N-th position B that has been detected (which is indicated by a dotted-line triangle in FIG. 11) (step S238). For example, as shown in FIG. 11, the position where ink ejection is to be ended is determined, allowing for a margin with a distance α from the N-th position B (this position is indicated by a solid-line triangle in FIG. 11).

On the other hand, if, in step S242, the position of the edge of the print paper P was not detected (for example, if the N-th position B has not been stored) due, for example, to malfunction of the reflective optical sensor 29, then a position that has been established in advance independent of the N-th position A is adopted as the ink-ejection start position (this position is indicated by a square in FIG. 11) (step S248). Similarly, a position that has been established in advance independent of the N-th position B is adopted as the ink-ejection end position (this position is indicated by an X in FIG. 11) (step S250).

It should be noted that in the above description, the margin α is set based, for example, on a detection error that occurs during detection of the edge of the print paper P, such that no unnecessary blank space is created on the print paper P. Further, in the above description, the value of the margin α was the same for when determining the start position and for when determining the end position. However, different values may be set.

Furthermore, it is preferable to set the above-described start position and the end position that are established in advance to include a sufficient margin, while taking into consideration the fact that no unnecessary blank space should be created on the print paper P. For example, it is possible to adopt the start position and the end position of the print data, which includes a certain amount of margin with respect to the size of the print paper as described in the section of the Background Art, as the start position and the end position that are established in advance.

Furthermore, in the above description, the N-th position B was obtained by adding the width of the print paper to the N-th position A that was detected. It is, however, possible to obtain the N-th position B by adding a margin to the width and then adding this to the N-th position A that was detected, taking into consideration situations in which the print paper is supplied in a skewed manner. Further, it is possible to find the skew of the print paper using some kind of means, and obtain the amount of margin to be added to the width based on the skew that was found. The above is applicable for obtaining the N-th position A by subtracting the width of the print paper from the N-th position B that was detected.

Furthermore, a program for carrying out the processes described above is stored in the EEPROM 58, and this program is executed by the system controller 54.

As described in the section of the Background Art, in order to eliminate the problem that ink is uselessly consumed by performing printing on a region outside the print paper, it is advantageous to adopt a method of detecting the position of the edge of the print paper and changing the start position and/or the end position for ejecting ink in accordance with the detected edge position. However, in carrying out this method, situations may occur in which the position of the edge of the print paper is not detected due to some reason. In such a situation, if the start position and/or the end position for ejecting ink is determined simply by using information about the position of an edge that was previously detected, instead of information about the position of the relevant edge, without changing the way of determining the start position and/or the end position for ejecting ink, then a problem that a blank space is unintentionally created on the print paper may arise. More specifically, the position of the edge that should have been detected and the position of an edge that was previously detected may significantly differ due to the print paper being supplied in a slanted (skewed) manner, and therefore, the above-described problem may arise if the start position and/or the end position is determined simply by using information about the position of an edge that was previously detected without changing the way of determining the start position and/or the end position for ejecting ink.

In view of this, in a case where the position of one of the two edges of the print paper was not detected as described above, it becomes possible to prevent a blank space from unintentionally being created on the print paper by determining the start position or the end position based on the position of the other edge, of among the positions of the two edges.

It should be noted that in the foregoing embodiment, the position of the one edge that was not detected was obtained from the position of the other edge, of among the positions of both edges, and the start position or the end position was determined based on the position of the one edge that has been obtained, in a case where the position of one edge, of among the positions of both edges, was not detected. This, however, is not a limitation. For example, the start position or the end position may be determined directly from the position of the other edge of the positions of both edges, without obtaining the position of the one edge that was not detected.

The foregoing embodiment, however, is more preferable because in this way, it is possible to determine the start position or the end position more easily.

Further, in the foregoing embodiment, the position of the one edge that was not detected was obtained from the position of the other edge, of among the positions of both edges, and a width of the print paper, and the start position or the end position was determined based on the position of the one edge that has been obtained, in a case where the position of one edge, of among the positions of both edges, was not detected. This, however, is not a limitation.

The foregoing embodiment, however, is more preferable because, by using information about the width of the print paper to obtain the position of the one edge that was not detected, it is possible to determine an appropriate start position or end position more accurately.

Other Embodiments

In the foregoing, a liquid ejecting apparatus etc. according to the invention was described based on embodiments thereof. However, the foregoing embodiments are for the purpose of elucidating the present invention and are not to be interpreted as limiting the present invention. The invention can of course be altered and improved without departing from the gist thereof and includes equivalents.

Print paper was described as an example of the medium, but it also possible to use, for example, film, cloth, or thin metal sheets as the medium.

In the foregoing embodiments, a printing apparatus was described as an example of the liquid ejecting apparatus. However, this is not a limitation. For example, technology like that of the foregoing embodiments can also be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The above-described effects can be maintained even when the present technology is adopted in these fields because of the feature that liquid can be ejected toward a medium.

Further, in the foregoing embodiments, a color inkjet printer was described as an example of the printing apparatus; however, this is not a limitation. For example, the present invention can also be applied to monochrome inkjet printers.

Further, in the foregoing embodiments, ink was used as an example of the liquid; however, this is not a limitation. For example, it is also possible to eject from the nozzles a liquid (including water) including metallic material, organic material (particularly macromolecular material), magnetic material, conductive material, wiring material, film-formation material, machining liquid, and genetic solution.

Further, in the foregoing embodiments, printing was performed with respect to the entire surface of the print paper, that is, so-called borderless printing was carried out. This, however, is not a limitation. For example, the above-described means achieve advantageous effects even when printing is performed not with respect to the entire surface of the print paper P, but with respect to a wide area thereof.

However, the advantages of the above-described means become more significant when borderless printing is performed, because printing is performed also onto the edges of the print paper.

Further, in the foregoing embodiments, the reflective optical sensor included a light-emitting section for emitting light, and a light-receiving section for receiving the light that moves in a main-scanning direction in accordance with the movement of the light-emitting section in the main-scanning direction; and the position of the edge was detected based on a change in an output value of the light-receiving section caused by the light emitted from the light-emitting section that moves in the main-scanning direction passing across the edge. This, however, is not a limitation.

The foregoing embodiments, however, are more preferable because in this way, it is possible to detect the position of the edge more easily.

Further, in the foregoing embodiments, positions of two edges that differ in position in the main-scanning direction were detected based on the change in the output value of the light-receiving section caused by the light emitted from the light-emitting section that moves in the main-scanning direction passing across the edges; and the start position was changed in accordance with one of the positions of the two edges that were detected, and the end position was changed in accordance with the other of the positions of the two edges that were detected. This, however, is not a limitation. For example, the position of a single edge may be detected during the detection operation based on the change in the output value of the light-receiving section caused by the light emitted from the light-emitting section that moves in the main-scanning direction passing across the edges, and the start position or the end position may be changed in accordance with the position of the single edge that was detected.

The foregoing embodiments, however, are more preferable because in this way, the above-described effect, that is, the effect of being able to prevent a blank space from unintentionally being created on the print paper, will be achieved more significantly.

Further, in the foregoing embodiments, the reflective optical sensor was provided on a movable carriage provided with the print head. This, however, is not a limitation. For example, the carriage and the reflective optical sensor may be configured to be movable separately.

The foregoing embodiments, however, are more preferable because in this way, it is possible to share the mechanism for moving the carriage and the reflective optical sensor.

Further, in the foregoing embodiments, while the carriage was moved in the main-scanning direction, the position of the edge was detected based on a change in an output value of the light-receiving section caused by the light emitted from the light-emitting section that moves in the main-scanning direction passing across the edge of the print paper, and the ink was ejected from the print head onto the print paper. This, however, is not a limitation. For example, the detection operation and the ejection operation may be carried out separately.

The foregoing embodiments, however, are more preferable because in this way, it is possible to achieve efficient operation.

Further, in the foregoing embodiments, description was made about a case in which the light emitted from the reflective optical sensor passed across the edge of the print paper but the position of the edge of the print paper P could not be detected due, for example, to malfunction of the reflective optical sensor 29. The foregoing embodiments, however, are applicable to cases in which the position of the edge of the print paper P could not be detected due to the light emitted from the reflective optical sensor not passing across the edge of the print paper, which may occur, for example, when the so-called logical seek mode is adopted.

===Configuration of Computer System Etc.===

Next, an embodiment of a computer system, which is an example of an embodiment of the present invention, will be described with reference to the drawings.

Figure 14:
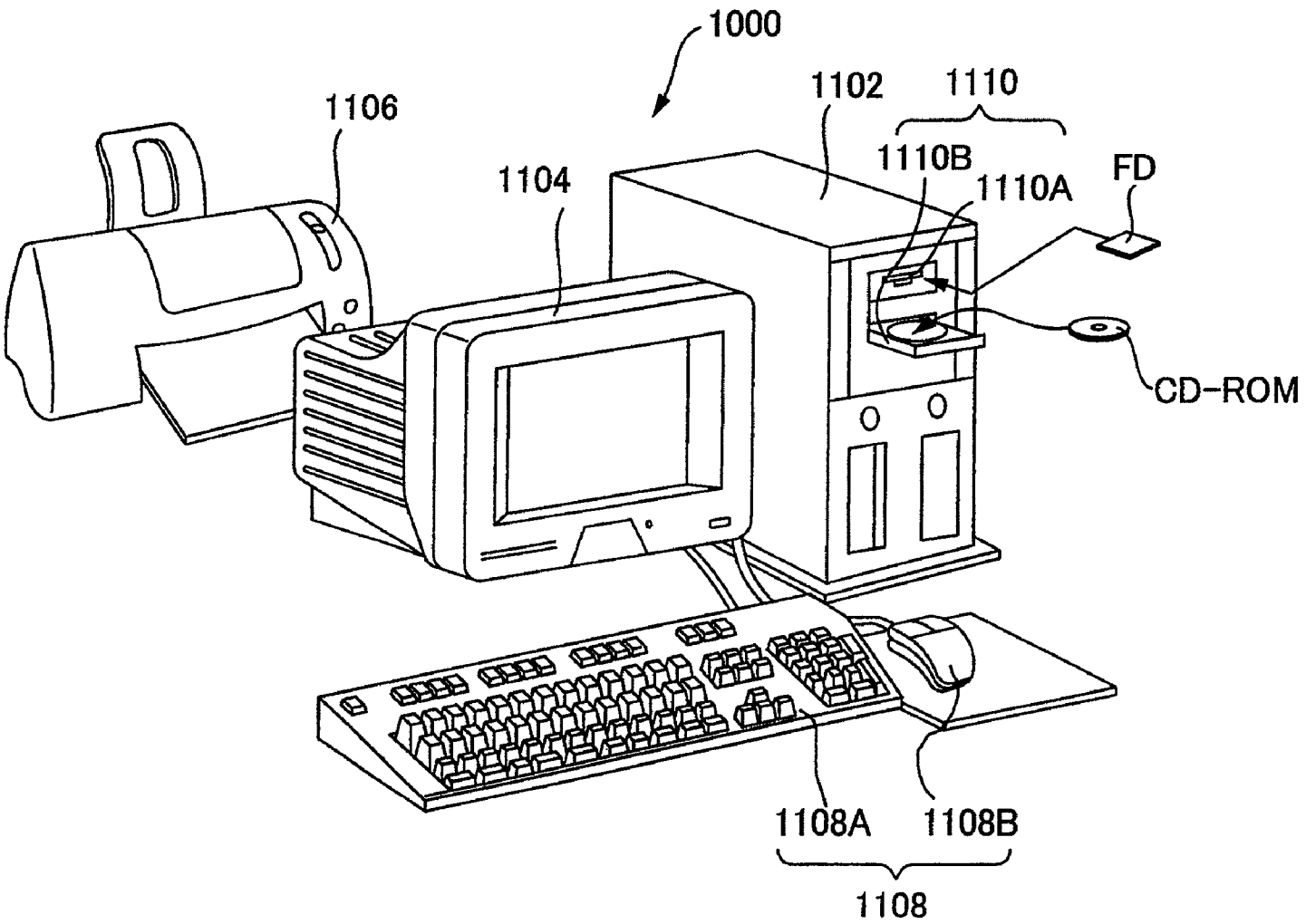
FIG. 14 is an explanatory diagram showing the external configuration of the computer system.

FIG. 14 is an explanatory diagram showing the external configuration of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magneto optical) disk drive device or a DVD (digital versatile disk), for example.

Figure 15:
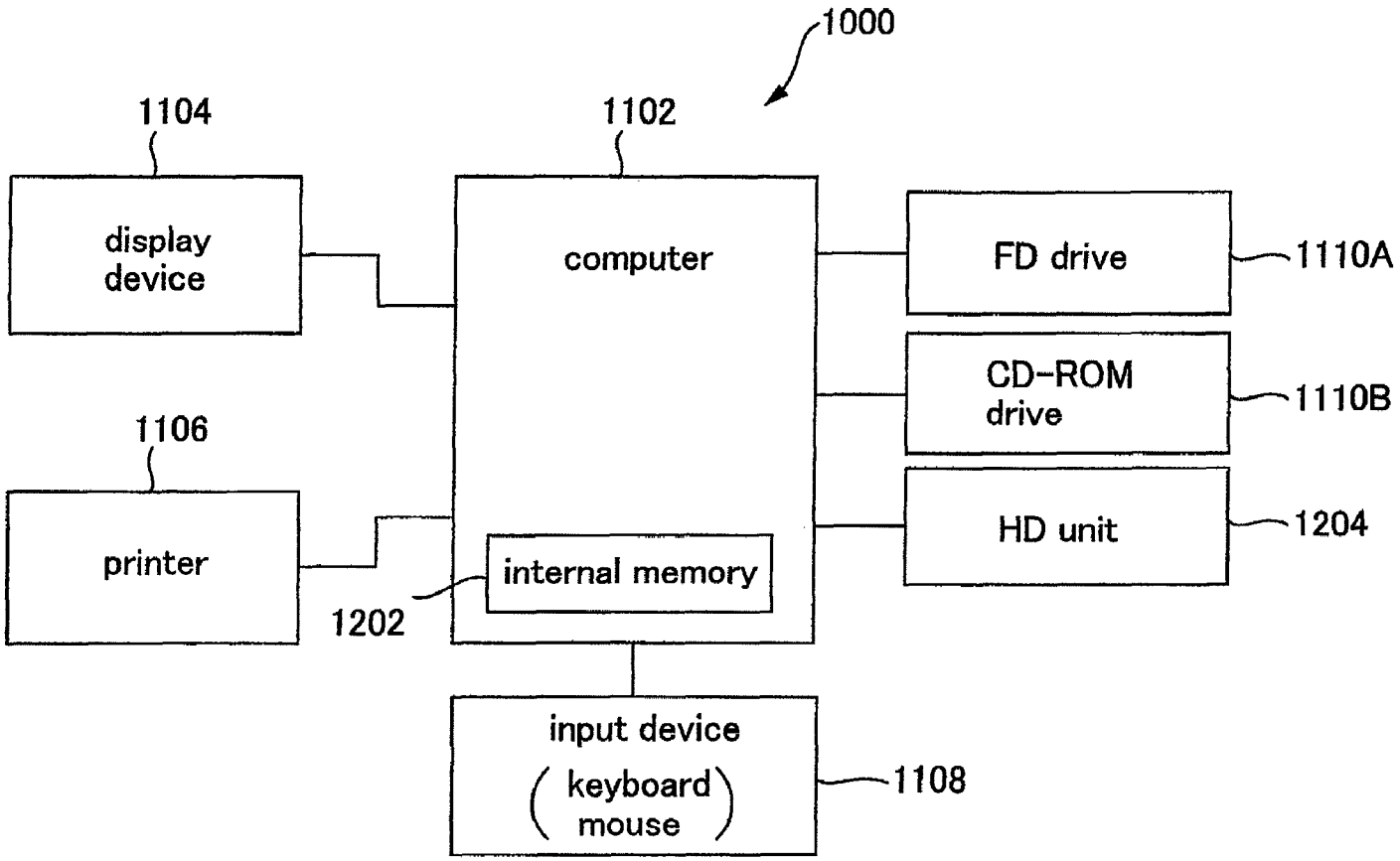
FIG. 15 is a block diagram showing the configuration of the computer system shown in FIG. 14.

FIG. 15 is a block diagram showing the configuration of the computer system shown in FIG. 14. An internal memory 1202 such as a RAM within the housing accommodating the main computer unit 1102 and, also, an external memory such as a hard disk drive unit 1204 are provided.

It should be noted that in the above description, an example was described in which the computer system is constituted by connecting the printer 1106 to the main computer unit 1102, the display device 1104, the input device 1108, and the reading device 1110. However, this is not a limitation. For example, the computer system can be made of the main computer unit 1102 and the printer 1106, or the computer system does not have to be provided with one of the display device 1104, the input device 1108, and the reading device 1110.

It is also possible for the printer 1106, for example, to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As an overall system, the computer system that is achieved in this way becomes superior to conventional systems.

INDUSTRIAL APPLICABILITY

According to the present invention, it becomes possible to achieve a liquid ejecting apparatus and a computer system with which no blank space is created on a medium.

The invention claimed is:

1. A liquid ejecting apparatus comprising:

a movable ejection head for ejecting a liquid;

a feed mechanism for feeding a medium; and detecting means for detecting a position of an edge of said medium;

wherein said liquid ejecting apparatus repeats an operation of detecting the position of said edge with said detecting means, an operation of feeding said medium with said feed mechanism, and an operation of ejecting the liquid onto said medium from said ejection head that is moving;

wherein, in accordance with the position of said edge that has been detected, said liquid ejecting apparatus changes at least either one of a start position and an end position for ejecting the liquid from said ejection head that is moving;

wherein, if the position of said edge was not detected, said liquid ejecting apparatus determines said start position or said end position based on a position of said edge that was detected in the past; and wherein, if the position of said edge was not detected, said liquid ejecting apparatus determines said start position or said end position based on a plurality of positions of said edge that were detected in the past.

2. A liquid ejecting apparatus according to claim 1, wherein, if the position of said edge was not detected, said liquid ejecting apparatus obtains the position of said edge that was not detected from the plurality of positions of said edge that were detected in the past, and determines said start position or said end position based on the position of said edge that has been obtained.

3. A liquid ejecting apparatus according to claim 2, wherein, if the position of said edge was not detected, said liquid ejecting apparatus obtains the position of said edge that was not detected from two positions of said edge that were detected in the past, and determines said start position or said end position based on the position of said edge that has been obtained.

4. A liquid ejecting apparatus according to claim 2, wherein, if the position of said edge was not detected, said liquid ejecting apparatus obtains the position of said edge that was not detected from the plurality of positions of said edge that were detected in the past and a feed amount by which said medium was fed from when the positions of said edge were detected, and determines said start position or said end position based on the position of said edge that has been obtained.

5. A liquid ejecting apparatus comprising:

a movable ejection head for ejecting a liquid;

a feed mechanism for feeding a medium; and detecting means for detecting positions of both edges of said medium;

wherein said liquid ejecting apparatus repeats an operation of detecting the positions of said both edges with said detecting means, an operation of feeding said medium with said feed mechanism, and an operation of ejecting the liquid onto said medium from said ejection head that is moving;

wherein, in accordance with at least either one of the positions of said both edges that have been detected, said liquid ejecting apparatus changes at least either one of a start position and an end position for ejecting the liquid from said ejection head that is moving; and wherein, if a position of one edge, of among the positions of said both edges, was not detected, said liquid ejecting apparatus determines said start position or said end position based on a position of the other edge, of among the positions of said both edges.

6. A liquid ejecting apparatus according to claim 5, wherein, if the position of one edge, of among the positions of said both edges, was not detected, said liquid ejecting apparatus obtains the position of said one edge that was not detected from the position of the other edge, of among the positions of said both edges, and determines said start position or said end position based on the position of said one edge that has been obtained.

7. A liquid ejecting apparatus according to claim 6, wherein, if the position of one edge, of among the positions of said both edges, was not detected, said liquid ejecting apparatus obtains the position of said one edge that was not detected from the position of the other edge, of among the positions of said both edges, and a width of said medium, and determines said start position or said end position based on the position of said one edge that has been obtained.

8. A liquid ejecting apparatus comprising:

a movable ejection head for ejecting a liquid;

a feed mechanism for feeding a medium; and detecting means for detecting a position of an edge of said medium;

wherein said liquid ejecting apparatus repeats an operation of detecting the position of said edge with said detecting means, an operation of feeding said medium with said feed mechanism, and an operation of ejecting the liquid onto said medium from said ejection head that is moving;

wherein, in accordance with the position of said edge that has been detected, said liquid ejecting apparatus changes at least either one of a start position and an end position for ejecting the liquid from said ejection head that is moving;

wherein, if the position of said edge was not detected, said liquid ejecting apparatus sets said start position or said end position to a position that has been established in advance;

wherein said detecting means includes light-emitting means for emitting light, and a light-receiving sensor for receiving said light that moves in a main-scanning direction in accordance with the movement of said light-emitting means in said main-scanning direction;

wherein the position of said edge is detected based on a change in an output value of said light-receiving sensor caused by the light emitted from said light-emitting means that moves in said main-scanning direction passing across said edge;

wherein positions of two edges that differ in position in said main-scanning direction are detected based on the change in the output value of said light-receiving sensor caused by the light emitted from said light-emitting means that moves in said main-scanning direction passing across said edges; and wherein said start position is changed in accordance with one of said positions of the two edges that were detected, and said end position is changed in accordance with the other of said positions of the two edges that were detected.

* * * * *

UNITED STATES PATENT AND TRADEMARK OFFICE

CERTIFICATE OF CORRECTION

PATENT NO. : 7,717,536 B2
APPLICATION NO. : 12/421989
DATED : May 18, 2010
INVENTOR(S) : Hironori Endo It is certified that error appears in the above-identified patent and that said Letters Patent is hereby corrected as shown below:

Title Page Insert

-- (30) Foreign Application Priority Data
Sept. 09, 2002 (JP) ..... 2002-262974 --

Signed and Sealed this

Sixteenth Day of November, 2010

David J. Kappos

David J. Kappos
*Director of the United States Patent and Trademark Office*